US011668473B2

(12) United States Patent
Kim et al.

(10) Patent No.: US 11,668,473 B2
(45) Date of Patent: Jun. 6, 2023

(54) AIR CONDITIONER

(71) Applicant: SAMSUNG ELECTRONICS CO., LTD., Suwon-si (KR)

(72) Inventors: Sung Jae Kim, Suwon-si (KR); Jin Gyun Kim, Suwon-si (KR); Young Tae Song, Suwon-si (KR); Hae Gyun Shin, Suwon-si (KR); Chang Sik Lee, Suwon-si (KR); Chang Woo Jung, Suwon-si (KR); Seo Young Cho, Suwon-si (KR); Sung Hyun Chun, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 23 days.

(21) Appl. No.: 16/577,450

(22) Filed: Sep. 20, 2019

(65) Prior Publication Data

US 2020/0096207 A1 Mar. 26, 2020

(30) Foreign Application Priority Data

Sep. 21, 2018 (KR) ..... 10-2018-0113748

(51) Int. Cl.
*F24F 1/029* (2019.01)
*F24F 1/0284* (2019.01)
(Continued)

(52) U.S. Cl.
CPC ..... *F24F 1/029* (2019.02); *F24F 1/0284* (2019.02); *F24F 1/035* (2019.02); *F24F 1/0323* (2019.02);
(Continued)

(58) Field of Classification Search
CPC ..... F24F 1/029; F24F 1/0284; F24F 1/0323; F24F 1/035; F24F 13/20; F24F 13/084;
(Continued)

(56) References Cited

U.S. PATENT DOCUMENTS 3,913,345 A * 10/1975 Goettl ..... F25B 25/00 261/106
11,079,119 B2 8/2021 Jeon et al.
(Continued)

FOREIGN PATENT DOCUMENTS

CN 101149170 3/2008
CN 101149170 B * 10/2010 ..... F24F 1/005
(Continued)

OTHER PUBLICATIONS

International Search Report dated Jan. 16, 2020 from International Application No. PCT/KR2019/012285, 4 pages.
(Continued)

*Primary Examiner* — Frantz F Jules
*Assistant Examiner* — Martha Tadesse
(74) *Attorney, Agent, or Firm* — Staas & Halsey LLP

(57) ABSTRACT

Disclosed herein is an air conditioner comprising, a housing in which an outlet is formed, a heat exchanger positioned inside the housing, and a fan positioned behind the heat exchanger. The fan configured to blow air to the heat exchanger. And a filter assembly coupled to the housing. The filter assembly configured to filter air entering the fan. The filter assembly covering a rear portion of the fan.

17 Claims, 25 Drawing Sheets

(51) Int. Cl.

| | |
|---|---|
| ***F24F 1/0323*** | (2019.01) |
| ***F24F 1/035*** | (2019.01) |
| ***F24F 13/20*** | (2006.01) |
| ***F24F 13/08*** | (2006.01) |
| ***F24F 13/30*** | (2006.01) |
| ***F24F 13/28*** | (2006.01) |

(52) U.S. Cl.
CPC ..... *F24F 13/084* (2013.01); *F24F 13/20* (2013.01); *F24F 13/28* (2013.01); *F24F 13/30* (2013.01); *F24F 2013/205* (2013.01)

(58) Field of Classification Search
CPC ..... F24F 13/30; F24F 13/28; F24F 2013/205; F24F 1/0014; F24F 8/10
See application file for complete search history.

(56) References Cited

U.S. PATENT DOCUMENTS

| | | | | |
|---|---|---|---|---|
| 2013/0105125 | A1* | 5/2013 | Oishi | F24F 1/0029 165/121 |
| 2017/0159947 | A1* | 6/2017 | Jeon | F24F 1/0014 |
| 2017/0284694 | A1* | 10/2017 | Park | F24F 1/0038 |
| 2018/0010812 | A1* | 1/2018 | Moro | F24F 1/0057 |
| 2018/0209667 | A1 | 7/2018 | Jeon et al. | |

FOREIGN PATENT DOCUMENTS

| | | | | |
|---|---|---|---|---|
| CN | 204574415 | U | 8/2015 | |
| CN | 105157203 | | 12/2015 | |
| CN | 105318438 | A | 2/2016 | |
| CN | 205065926 | U | 3/2016 | |
| CN | 105972696 | | 9/2016 | |
| CN | 106352401 | | 1/2017 | |
| CN | 106662358 | | 5/2017 | |
| CN | 106716021 | | 5/2017 | |
| CN | 206514388 | | 9/2017 | |
| EP | 2 597 393 | A2 | 5/2013 | |
| EP | 2 597 393 | A3 | 7/2014 | |
| EP | 3 104 087 | A1 | 12/2016 | |
| EP | 3104087 | A1 * | 12/2016 | B01D 46/0072 |
| EP | 3 163 177 | A1 | 5/2017 | |
| EP | 3 183 508 | A1 | 6/2017 | |
| JP | 7-158961 | | 6/1995 | |
| JP | 2557783 | B2 * | 11/1996 | |
| JP | 2006-336910 | | 12/2006 | |
| JP | 2011094936 | A * | 5/2011 | |
| JP | WO 2017/134720 | | 8/2017 | |
| JP | WO 2016/162977 | | 10/2017 | |
| KR | 10-2005-0024797 | | 3/2005 | |
| KR | 10-2006-0035239 | | 4/2006 | |
| KR | 10-2008-0014473 | | 2/2008 | |
| KR | 10-2008-0025601 | | 3/2008 | |
| KR | 10-2014-0028190 | | 3/2014 | |
| KR | 10-2017-0009808 | | 1/2017 | |
| WO | 2008/069379 | A2 | 6/2008 | |
| WO | 2008/069379 | A3 | 6/2008 | |
| WO | WO-2017017851 | A1 * | 2/2017 | F24F 1/00 |

OTHER PUBLICATIONS

Extended European Search Report dated Jul. 15, 2021 from European Application No. 19863611.0.
Chinese Office Action dated Apr. 28, 2022 from Chinese Application No. 201980061545.4.
Chinese Office Action dated Nov. 10, 2022 in Chinese Patent Application No. 201980061545.4 (7 pages; 10 pages English translation).
Office Action dated Feb. 17, 2023 in Korean Patent Application No. 10-2018-0113748 (5 pages; 7 pages English translation).
Office Action dated Mar. 21, 2023 in Chinese Patent Application No. 201980061545.4 (2 pages; 3 pages English translation).

* cited by examiner

AIR CONDITIONER

CROSS-REFERENCE TO RELATED APPLICATIONS

This application is based on and claims priority under 35 U.S.C. § 119 to Korean Patent Application No. 10-2018-0113748, filed on Sep. 21, 2018 in the Korean Intellectual Property Office, the disclosure of which is incorporated by reference herein in its entirety.

BACKGROUND

1. Field

The disclosure relates to an air conditioner, and more particularly, to an air conditioner with an improved assembly structure.

2. Description of the Related Art

In general, an air conditioner is an apparatus for adjusting the temperature, humidity, air current, and distribution to optimal conditions for human activities using a cooling cycle. Main components constituting the cooling cycle include a compressor, a condenser, an evaporator, and a blow fan.

The air conditioner is classified into a split type air conditioner in which an indoor unit is separated from an outdoor unit, and a window type air conditioner in which an indoor unit and an outdoor unit are installed together in a single cabinet. The indoor unit of the split type air conditioner includes a heat exchanger for heat-exchanging air suctioned to the inside of the panel, and a fan for inhaling indoor air to the inside of the panel and again discharging the suctioned air to an indoor space.

Typically, in order to replace the fan with a new one or repair the fan, the indoor unit should be disassembled. However, even after the front panel is disassembled, the fan is covered by the heat exchanger or other components that should be disassembled earlier than the fan exist in the inside of the indoor unit. For this reason, there are difficulties in replacing the fan with new one.

SUMMARY

Therefore, it is an aspect of the disclosure to provide an air conditioner with an improved assembly structure.

It is another aspect of the disclosure to provide an air conditioner with a simple assembly process.

It is another aspect of the disclosure to provide an air conditioner with improved durability.

It is another aspect of the disclosure to provide an air conditioner with an improved structure for easy maintenance.

Additional aspects of the disclosure will be set forth in part in the description which follows and, in part, will be obvious from the description, or may be learned by practice of the disclosure.

In accordance with an aspect of the disclosure, an air conditioner includes: a housing in which an outlet is formed; a heat exchanger positioned inside the housing; a fan positioned behind the heat exchanger and configured to blow outside air to the heat exchanger, the fan being exposed to a rear side of the housing; and a filter assembly coupled with the housing and configured to filter outside air entering the fan, the filter assembly covering an exposed rear portion of the fan.

The fan may be separable from the rear side of the housing.

The air conditioner may further include a fan guard partitioning the fan from the heat exchanger.

The fan guard may include a fan grill guiding air blown from the fan, wherein a front surface of the fan grill may face the heat exchanger and a rear surface of the fan grill faces the fan.

The filter assembly may include a frame guard formed in a lattice shape to protect the fan and facing a rear surface of the fan.

When the filter assembly is separated from the housing, the fan may be separable from the fan guard.

The housing may include a rear panel which forms a rear surface of the housing and on which the fan guard is installed, and the rear panel and the fan guard may partition a front space in which the heat exchanger is positioned from a rear space in which the filter assembly is positioned.

The heat exchanger may be separated from the rear panel in a front direction of the fan guard, and the fan and the filter assembly may be separated from the rear panel in a rear direction of the fan guard.

The filter assembly may include: a filter configured to filter air entering the fan; a filter frame supporting the filter, wherein the filter frame comprises a frame guard formed in a lattice shape to protect the fan.

The filter frame may include an inner frame and an outer frame respectively supporting a front side and a rear side of the filter, and the frame guard may be formed in the inner frame such that a front surface of the frame guard faces the fan.

The filter assembly may include a second coupling hole formed in a upper portion of the filter frame and overlapping a first coupling hole formed in an upper portion of the housing, and the filter assembly may be fixed at the housing when the first coupling hole is screwed with the second coupling hole.

The housing may include a rear panel which forms a rear surface of the housing and on which the fan guard is installed, and the fan guard may be separable in a rear direction with respect to the rear panel together with the fan.

The fan guard may include: at least one catching protrusion configured to be caught at the rear panel; and a coupling portion coupled for the fan guard to be fixed to the rear panel.

The at least one catching protrusion may include: an extension portion extending toward a front surface of the rear panel; and a catching portion bent from the extension portion and being in contact with the front surface of the rear panel.

The at least one catching protrusion and the coupling portion may be spaced apart from each other a predetermined distance along a circumference of the fan guard.

The heat exchanger may be positioned between the outlet and the fan.

In accordance with another aspect of the disclosure, an air conditioner includes: a housing comprising a front panel in which an outlet is formed, and a rear panel; a heat exchanger positioned inside the housing; a fan assembly comprising a fan guard, and a fan positioned in the fan guard and configured to blow outside air to the heat exchanger, the fan assembly being exposed to a rear side of the housing; and a filter assembly coupled with the rear side of the housing and configured to filter outside air entering the fan, the filter assembly covering an exposed rear portion of the fan assembly, wherein the fan assembly may be disposed to be separable to the rear side of the housing.

When the filter assembly is separated from the housing, the fan assembly may be separable from the fan guard.

The fan guard may include: at least one catching protrusion configured to be caught at the rear panel; a coupling portion coupled for the fan guard to be fixed to the rear panel, wherein the at least one catching protrusion and the coupling portion may be spaced apart from each other a predetermined distance along a circumference of the fan guard.

In accordance with another aspect of the disclosure, an air conditioner includes: a housing comprising a front panel in which an outlet is formed, and a rear panel forming a rear surface of the housing; a heat exchanger positioned inside the housing; and a fan assembly comprising a fan guard positioned behind the heat exchanger, and a fan positioned in the fan guard and configured to blow outside air to the heat exchanger, the fan assembly being positioned on the rear panel and exposed to a rear side of the housing, wherein the fan assembly may be configured to be separable in a rear direction from the rear panel.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
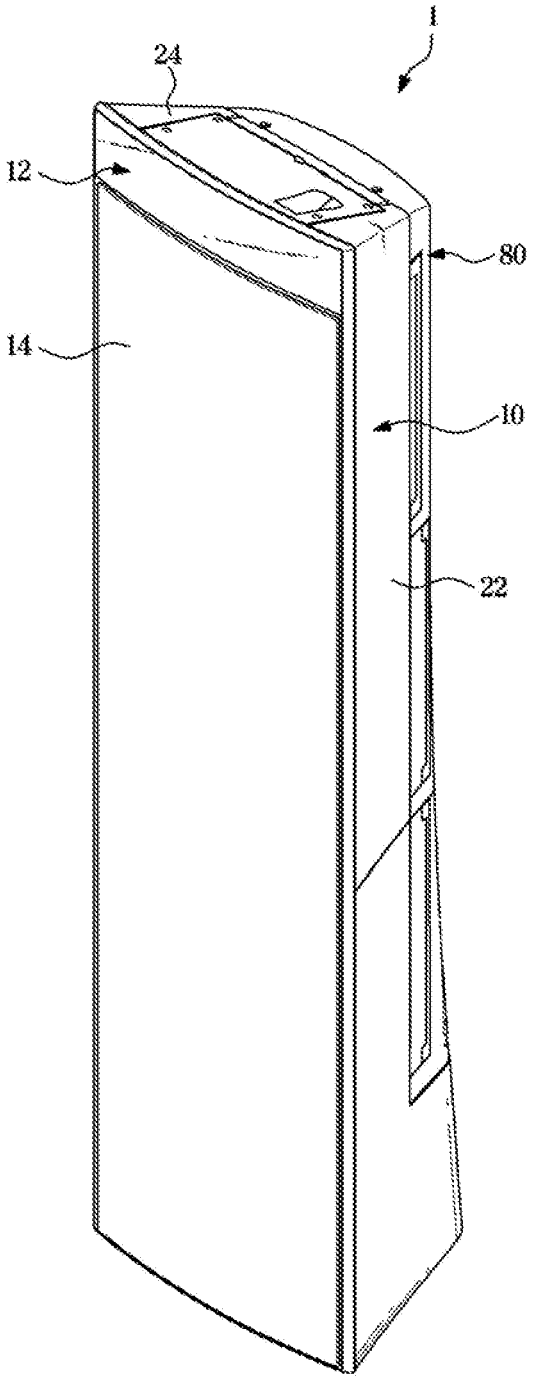
FIG. 1 is a perspective view of an air conditioner according to an embodiment of the disclosure.

Configurations illustrated in the embodiments and the drawings described in the present specification are only the preferred embodiments of the disclosure, and thus it is to be understood that various modified examples, which may replace the embodiments and the drawings described in the present specification, are possible at the time of the filing of the present application.

Also, like reference numerals or symbols denoted in the drawings of the present specification represent members or components that perform the substantially same functions.

The terms used in the present specification are merely used to describe embodiments, and are not intended to limit the disclosure. An expression used in the singular encompasses the expression of the plural, unless it has a clearly different meaning in the context. In the present specification, it is to be understood that the terms such as "comprising", "including" or "having", etc., are intended to indicate the existence of the features, numbers, operations, components, parts, or combinations thereof disclosed in the specification, and are not intended to preclude the possibility that one or more other features, numbers, operations, components, parts, or combinations thereof may exist or may be added.

It will be understood that, although the terms "first", "second", etc., may be used herein to describe various elements, these elements should not be limited by these terms. The above terms are used only to distinguish one component from another. For example, a first component discussed below could be termed a second component, and similarly, a second component may be termed a first component without departing from the teachings of this disclosure. As used herein, the term "and/or" includes any and all combinations of one or more of associated listed items.

Hereinafter, the embodiments of the disclosure will be described in detail with reference to the accompanying drawings.

A cooling cycle constituting an air conditioner may be configured with a compressor, a condenser, an expansion valve, and an evaporator. The cooling cycle may perform a series of processes of compression-condensation-expansion-evaporation so as to heat-exchange high-temperature air with low-temperature refrigerants and then supply low-temperature air to an indoor space.

The compressor may compress refrigerant gas to a high-temperature, high-pressure state, and discharge the compressed refrigerant gas to the condenser. The condenser may condense the compressed refrigerant gas to a liquid state, and emit heat to the surroundings during the condensing process. The expansion valve may expand the liquid-state refrigerants in the high-temperature, high-pressure state condensed by the condenser to liquid-state refrigerants in a low-pressure state. The evaporator may evaporate the refrigerants expanded by the expansion valve. The evaporator may achieve a cooling effect through heat-exchange with an object to be cooled using evaporative latent heat of refrigerants, and return the refrigerant gas in the low-temperature, low-pressure state to the compressor. Through the cycle, the air conditioner may adjust the temperature of an indoor space.

An outdoor unit of the air conditioner may be a part of the cooling cycle, configured with the compressor and an outdoor heat exchanger. The expansion valve may be positioned at any one of the indoor unit or the outdoor unit, and the indoor heat exchanger may be positioned at the indoor unit of the air conditioner.

The disclosure relates to the air conditioner for cooling an indoor space, wherein the outdoor heat exchanger may function as a condenser and the indoor heat exchanger may function as an evaporator. Hereinafter, for convenience of description, an indoor unit including an indoor heat exchanger is referred to as an air conditioner, and the indoor heat exchanger is referred to as an heat exchanger.

Figure 2:
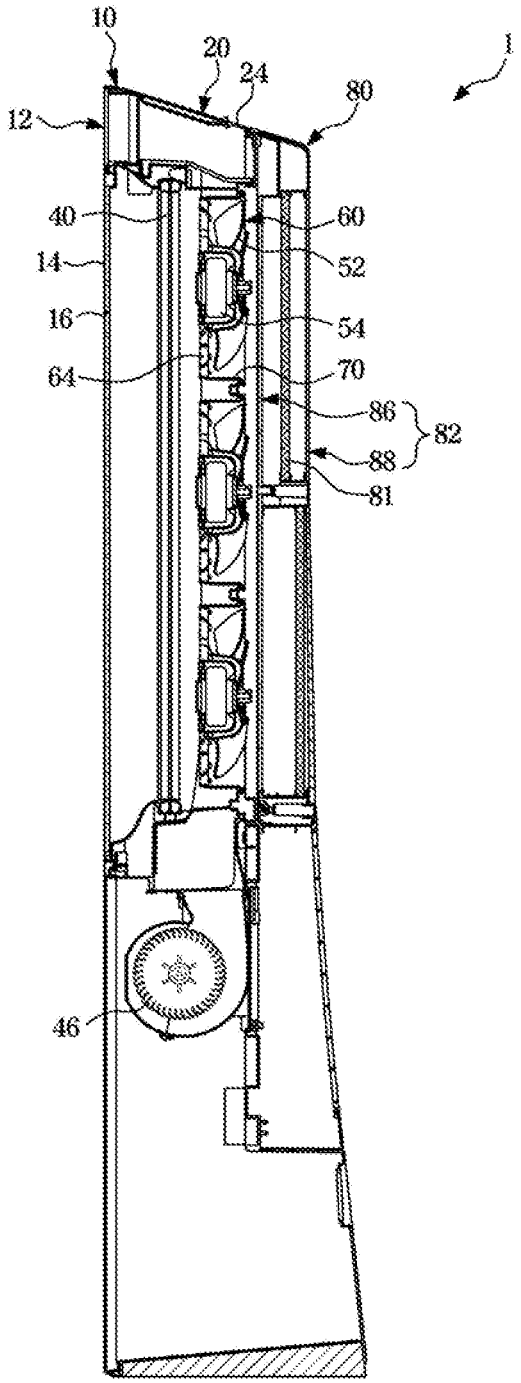
FIG. 2 is a cross-sectional view of an air conditioner according to an embodiment of the disclosure.
Figure 3:
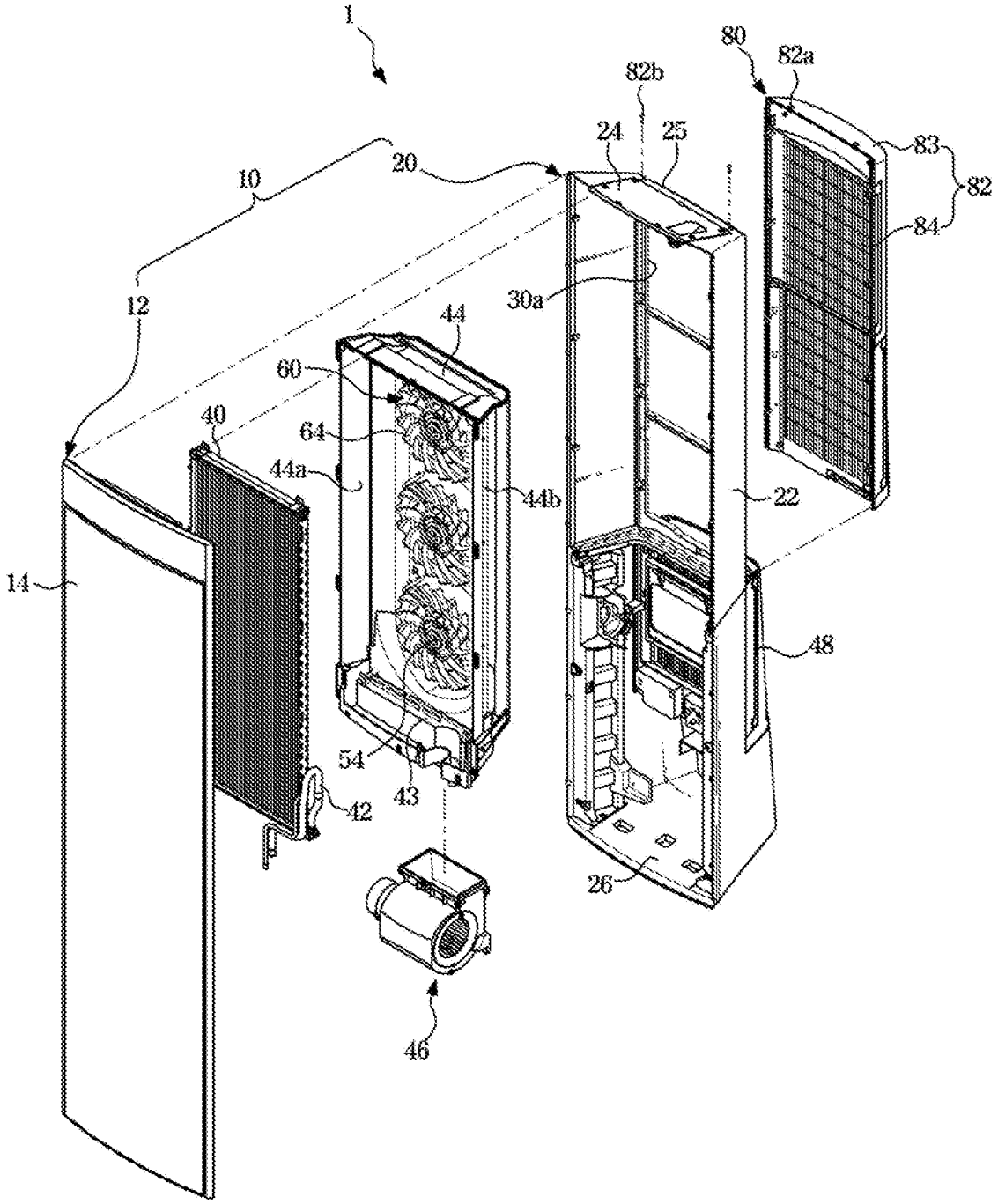
FIG. 3 is an exploded perspective view of an air conditioner according to an embodiment of the disclosure.
Figure 4:
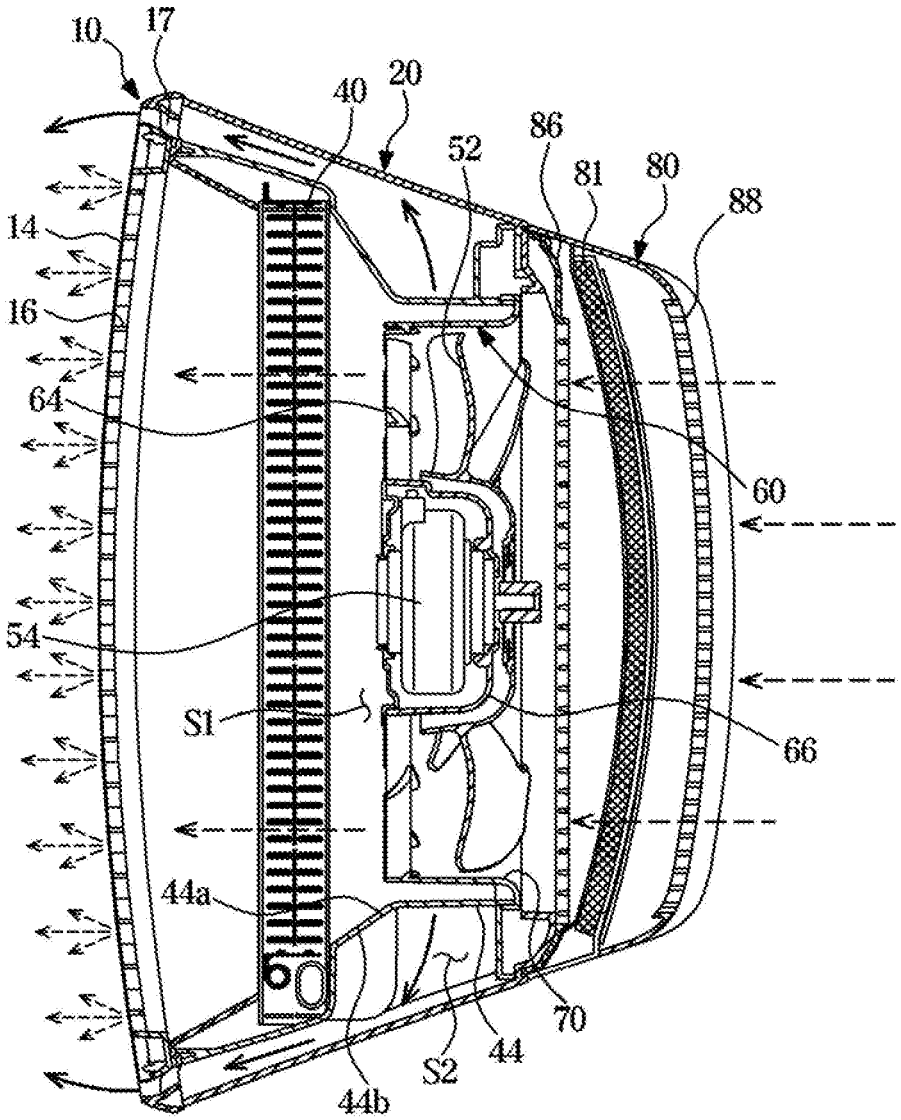
FIG. 4 is a cross-sectional view of an air conditioner according to an embodiment of the disclosure.

FIG. 1 is a perspective view of an air conditioner according to an embodiment of the disclosure, FIG. 2 is a cross-sectional view of an air conditioner according to an embodiment of the disclosure, FIG. 3 is an exploded perspective view of an air conditioner according to an embodiment of the disclosure, and FIG. 4 is a cross-sectional view of an air conditioner according to an embodiment of the disclosure.

An air conditioner 1 may include a housing 10 having an outlet, a heat exchanger 40 for heat-exchanging air entering the inside of the housing 10, and a fan assembly 50 (see FIG. 5) having a fan 52 for circulating air to the inside or outside of the housing 10. The outlet is a configuration for discharging air passed through the inside of the air conditioner 1, and may include an outlet opening 17 and a plurality of discharging holes 16 formed in a front panel 14, which will be described later.

In the current embodiment, the air conditioner 1 may be a stand type air conditioner, although not limited thereto.

The housing 10 may form an outer appearance of the air conditioner 1. The housing 10 may include a front frame 12 and a rear frame 20. The front frame 12 may include the front panel 14. The rear frame 20 may include a rear panel 30 (see FIG. 5) positioned behind the front panel 14, a pair of side panels 22 positioned between the front panel 14 and the rear panel 30, a upper panel 24 forming an upper surface of the housing 10, and a lower panel 26 forming a lower surface of the housing 10. However, kinds of panels constructing the front frame 12 and the rear frame 20 are not limited to these.

The front panel 14 may include the plurality of discharging holes 16. The plurality of discharging holes 16 may penetrate the front panel 14. The plurality of discharging holes 16 may be formed in a micro size. The plurality of discharging holes 16 may be distributed uniformly over the entire area of the front panel 14. Air heat-exchanged by the heat exchanger 40 may be discharged to outside at uniform low speed by the plurality of discharging holes 16. The current embodiment relates to an example in which the plurality of discharging holes 16 are formed in the front panel 14. However, an opening (not shown) that is larger than the plurality of discharging holes 16 may be formed in the front panel 14. The outlet may include an opening. The opening may be formed in the front panel 14 so that air heat-exchanged by the heat exchanger 40 is discharged to outside without air resistance. Because the plurality of discharging holes 16 are significantly smaller than the opening, speed of air heat-exchanged by the heat exchanger 40 may be reduced by air resistance of the plurality of discharging holes 16 to be discharged to outside at uniform low speed. An example in which the plurality of discharging holes 16 are formed in the front panel 14 is provided, however, the disclosure is not limited to this example.

The rear panel 30 may include an inlet 30*a*. The inlet 30*a* may penetrate the rear panel 30. Air passed through the filter assembly 80 through the inlet 30*a* may enter the inside of the housing 10.

The heat exchanger 40 may be positioned inside the housing 10. The heat exchanger 40 may be positioned on a moving path of air entered from behind the housing 10 and moving toward a front direction. The heat exchanger 40 may be positioned on a moving path of air arriving at the opening of the front panel 14 from the fan 52. More specifically, the heat exchanger 40 may be positioned on a first flow path S1 which will be described later. The heat exchanger 40 may absorb heat from air entered the housing 10 or transfer heat to air entered the housing 10. In a lower portion of the heat exchanger 40, a drain panel 43 may be provided to collect water condensed in the heat exchanger 40. The drain panel 43 may be connected to a drain hose 42 connected to the outside of the housing 10 to discharge the condensed water to the outside of the housing 10.

The front frame 12 may include the outlet opening 17 (see FIG. 4). The outlet opening 17 may be formed to left and right sides of the front panel 14. The outlet opening 17 may be positioned adjacent to the front panel 14. The outlet opening 17 may extend in a up-down direction of the front panel 14. The outlet opening 17 may have substantially the same length as that of the front panel 14. Air not heat-exchanged inside the housing 10 may be discharged to the outside of the housing 10 through the outlet opening 17. Air discharged from the outlet opening 17 may be mixed with air discharged through the plurality of discharging holes 16 of the front panel 14 and then discharged to the outside.

The air conditioner 1 may include a blowing unit 46.

The blowing unit 46 may be positioned in a lower area of the housing 10 to cause outside air of the air conditioner 1 to flow to the outlet opening 17. When the fan assembly 50 which will be described later is positioned in an upper area of the air conditioner 1, the blowing unit 46 may be positioned in the lower area of the air conditioner 1. Air passed through a lower filter 48 installed on a rear side of the housing 10 may flow to the outlet opening 17 by the blowing unit 46. That is, air passed through the lower filter 48 may flow along a second flow path S2 which will be described later, by the blowing unit 46, and then flow to the outlet opening 17.

The fan assembly 50 may include the fan 52 and a fan guard 60.

The fan 52 may blow air to discharge outside air of the housing 10 through the opening of the housing 10. The fan 52 may be positioned inside the housing 10. The type of the fan 52 is not limited.

The fan guard 60 may be configured to locate the fan 52. The fan 52 may be positioned in the fan guard 60. The fan guard 60 may be in a shape that is concave in a front direction, and in a space formed by the concave shape, the fan 52 may be positioned. The fan guard 60 may protect the fan 52 or guide air blown from the fan 52. The fan assembly 50 will be described in detail, later.

The filter assembly 80 may be positioned behind the housing 10. The filter assembly 80 may filter out foreign materials from air entering the housing 10. The filter assembly 80 may be coupled with the rear panel 30 of the housing 10. The filter assembly 80 will be described in detail, later.

A flow path of air blowing and flowing by the fan assembly 50 to be discharged through the plurality of discharging holes 16 of the front panel 14 is referred to as the first flow path S1 (see FIG. 4). A flow path of air blowing and flowing by the blowing unit 46 to be discharged through the outlet opening 17 of the front frame 12 is referred to as the second flow path S2 (see FIG. 4). The first flow path S1 may be partitioned from the second flow path S2. That is, air flowing along the first and second flow paths S1 and S2 may not be mixed inside the housing 10.

The air conditioner 1 may include a partition member 44. The partition member 44 may partition the first flow path S1 from the second flow path S2 inside the housing 10. The partition member 44 may be positioned inside the housing 10. The partition member 44 may be separated from the rear frame 20. The partition member 44 may be installed on the rear frame 20 in such a way to be surrounded by the side panels 22 and the upper panel 24. The partition member 44 may be in a shape that is concave substantially toward a rear direction. The partition member 44 may form the first flow path S1 in the inside and form the second flow path S2 in the outside. The first flow path S1 may be formed by an inner surface 44*a* of the partition member 44 and the second flow path S2 may be formed by an outer surface 44*b* of the partition member 44.

In the current embodiment, the rear panel 30 means a panel forming the rear portion of the housing 10. The partition member 44 may be coupled with the housing 10, and a rear portion of the partition member 44 may cover at least one portion of the inlet 30*a* of the rear panel 30. The rear panel 30 which will be described below may be a configuration including a panel forming the rear surface of the housing 10 and a rear surface of the partition member 44. That is, the rear panel 30 means a rear surface of the rear frame 12 with which the partition member 44 is coupled.

Figure 5:
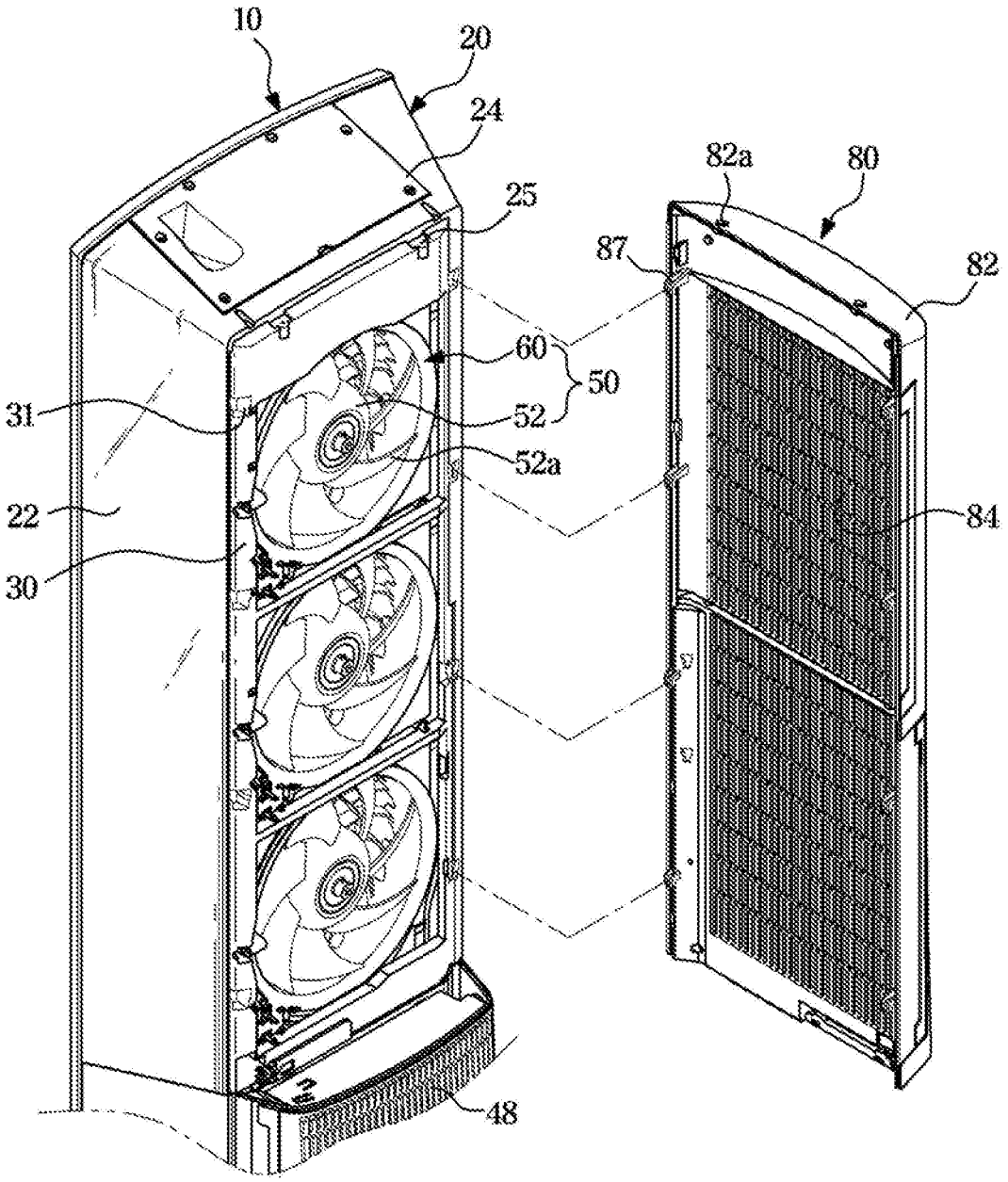
FIG. 5 is a disassembled perspective view of a housing and a filter assembly of an air conditioner according to an embodiment of the disclosure.
Figure 6:
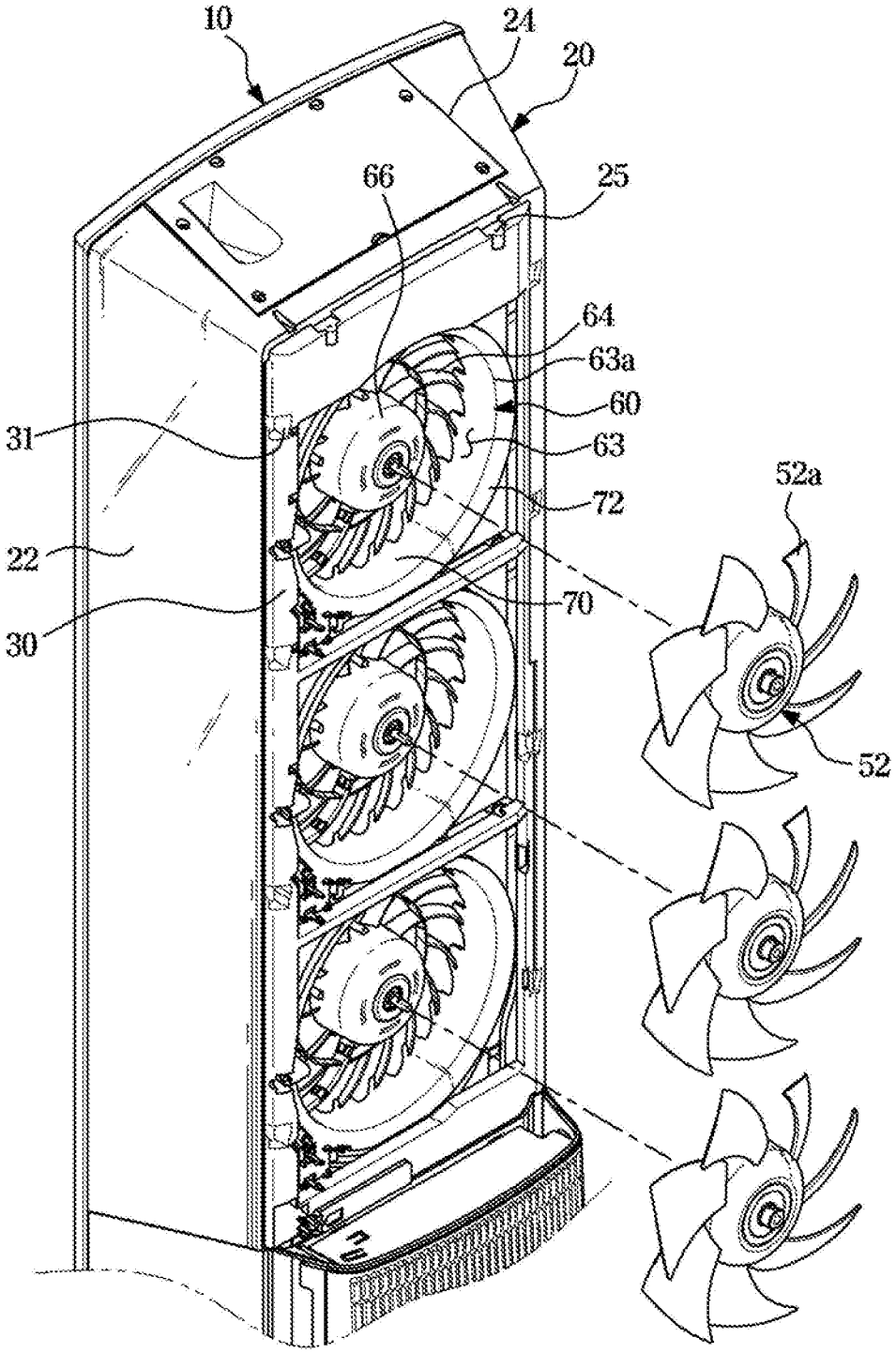
FIG. 6 shows a state in which fans are separated from an air conditioner according to an embodiment of the disclosure.

FIG. 5 is a disassembled perspective view of a housing and a filter assembly of an air conditioner according to an embodiment of the disclosure, and FIG. 6 shows a state in which fans are separated from an air conditioner according to an embodiment of the disclosure.

The fan assembly 50 may be exposed to a rear side of the housing 10. The fan assembly 50 may be coupled with the rear panel 30 of the housing 10. The fan assembly 50 may be separated in the rear direction from the housing 10.

The fan assembly 50 may include the fan 52 and the fan guard 60, as described above.

The fan 52 may be exposed to the rear side of the housing 10. Because the filter assembly 80 covers the rear side of the housing 10, the fan 52 may become a separable state when the filter assembly 80 is separated from the housing 10 as shown in FIG. 5. When the fan 52 is decoupled from a fan motor 54, the fan 52 may be separated from the rear side of the housing 10.

At least one fan 52 may be provided. In the current embodiment, three fans 52 may be arranged at intervals in the up-down direction. However, the arrangement and number of the fans 52 are not limited.

The fan guard 60 may locate the fan 52 in the inside. The fan guard 60 may be coupled with the rear frame 20 of the housing 10. More specifically, the fan guard 60 may be coupled with the rear panel 30 of the housing 10. The rear panel 30 and the fan guard 60 may partition a front space in which the heat exchanger 40 is positioned from a rear space in which the filter assembly 80 is positioned.

The fan guard 60 may be formed in the shape of a cylinder, and one side of the fan guard 60 may open. The fan guard 60 may include an arrangement space 63 in which the fan 52 is arranged, and an opening 63*a* through which the fan 52 is inserted into or escapes from the arrangement space 63. The fan 52 may be separated or coupled through the opening 63*a* of the fan guard 60. The opening 63*a* of the fan guard 60 may open toward the rear side of the housing 10.

To correspond to the at least one fan 52, at least one fan guard 60 may be provided. In the current embodiment, to correspond to a plurality of fans 52 arranged at intervals in the up-down direction, a plurality of fan guards 60 may also be arranged at intervals in the up-down direction.

The filter assembly 80 may cover the fan 52 or the fan assembly 50. The filter assembly 80 may cover the fan 52 or the fan assembly 50 exposed to the rear side of the housing 10. The filter assembly 80, which is a single assembly, may be removably coupled with the housing 10. The filter assembly 80 may be coupled with the rear panel 30 of the housing 10.

A single fan assembly 50 may be provided. However, in the current embodiment, a plurality of fan assemblies 50 may be arranged at intervals in the up-down direction. Also, a plurality of filter assemblies 80 may be provided to cover the plurality of fan assemblies 50, respectively. In the current embodiment, the filter assemblies 80 may extend in the up-down direction to cover the plurality of fan assemblies 50, in consideration of the arrangement direction of the plurality of fan assemblies 50.

Figure 7:
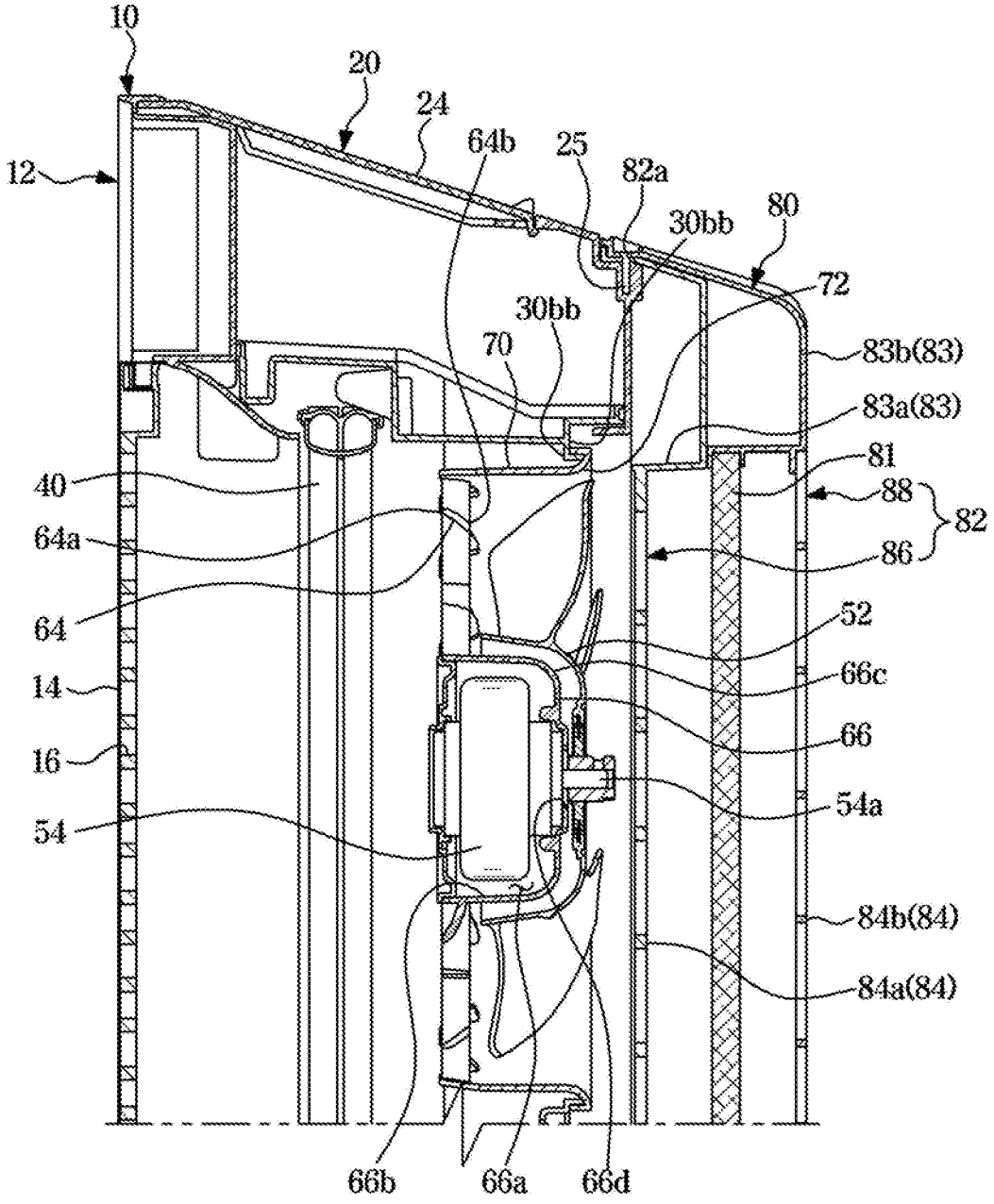
FIG. 7 is an enlarged view of a cross section of an air conditioner according to an embodiment of the disclosure.

FIG. 7 is an enlarged view of a cross section of an air conditioner according to an embodiment of the disclosure.

The fan guard 60 may include a fan grill 64 and a duct 70.

The fan grill 64 may guide air flowing by the fan 52. The fan grill 64 may be positioned in front of the fan 52 to guide air blown by the fan 52. A front surface 64*a* of the fan grill 64 may face the heat exchanger 40, and a rear surface 64*b* of the fan grill 64 may face the fan 52. That is, the fan grill 64 may partition the heat exchanger 40 from the fan 52.

As shown in FIG. 6, the fan grill 64 may be curved in a clockwise direction from the center, as seen from behind the housing 10. The fan 52 may have a blade 52*a* that is curved in a counterclockwise direction from the center. Because the curved direction of the fan grill 64 is opposite to the curved direction of the blade 52*a* of the fan 52, air blown by the fan 52 may move further straight when passing through the fan grill 64.

The duct 70 may surround the fan 52. The fan 52 may be positioned inside the duct 70, and the duct 70 may guide air flowing by the fan 52.

The fan guide 60 may include a shroud 72. The shroud 72 may prevent air from entering between the rear panel 30 and the fan guard 60, thereby increasing heat-exchange efficiency and preventing a reduction in air volume of the fan 52. The shroud 72 may extend along a circumference of the duct 70. The shroud 72 may be in contact with a rear surface 30*bb* (see FIGS. 7 and 17) of the rear panel 30.

The fan guard 60 may include a motor resting portion 66, and the fan motor 54 rested on the motor resting portion 66 to operate the fan 52.

The motor resting portion 66 may be positioned at the center of the fan grill 64. The motor resting portion 66 may protrude in the rear direction from the fan grill 64, and a front surface 66*b* of the motor resting portion 66 may be concave as seen from front. That is, the front surface 66*b* of the motor resting portion 66 may be concave as seen from front, and a rear surface 66*c* of the motor resting portion 66 may be convex toward the rear direction. Through the configuration, the fan motor 54 may be positioned in a concave space 66*a* of the motor resting portion 66. In the motor resting portion 66, a through hole 66*d* may be formed. A rotation shaft 54*a* of the fan motor 54 may extend in the rear direction through the through hole 66*d*, and be coupled with the fan 52 positioned in the arrangement space 63 of the fan guard 60.

Figure 8:
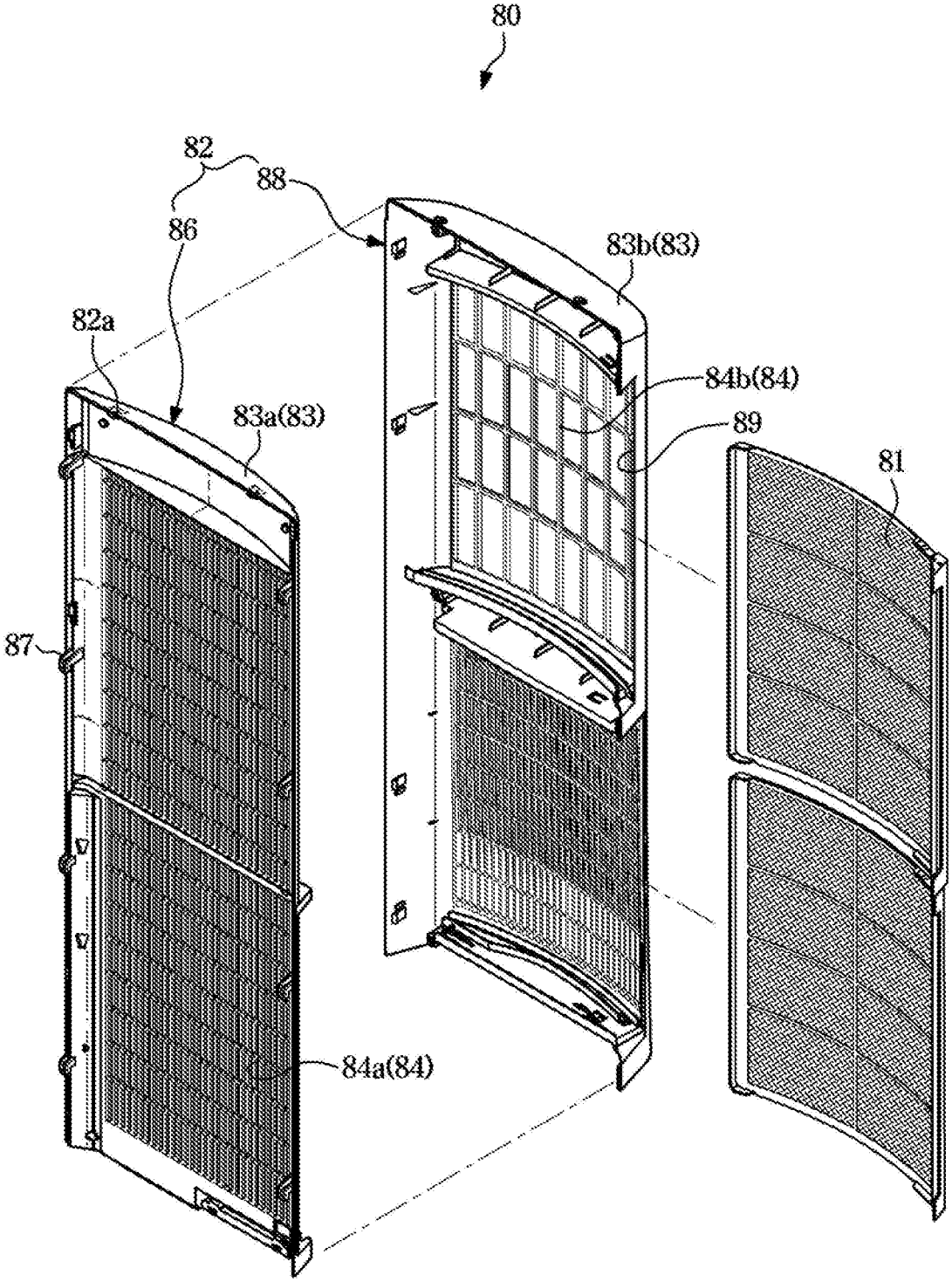
FIG. 8 is an exploded perspective view of a filter assembly of an air conditioner according to an embodiment of the disclosure.
Figure 9:
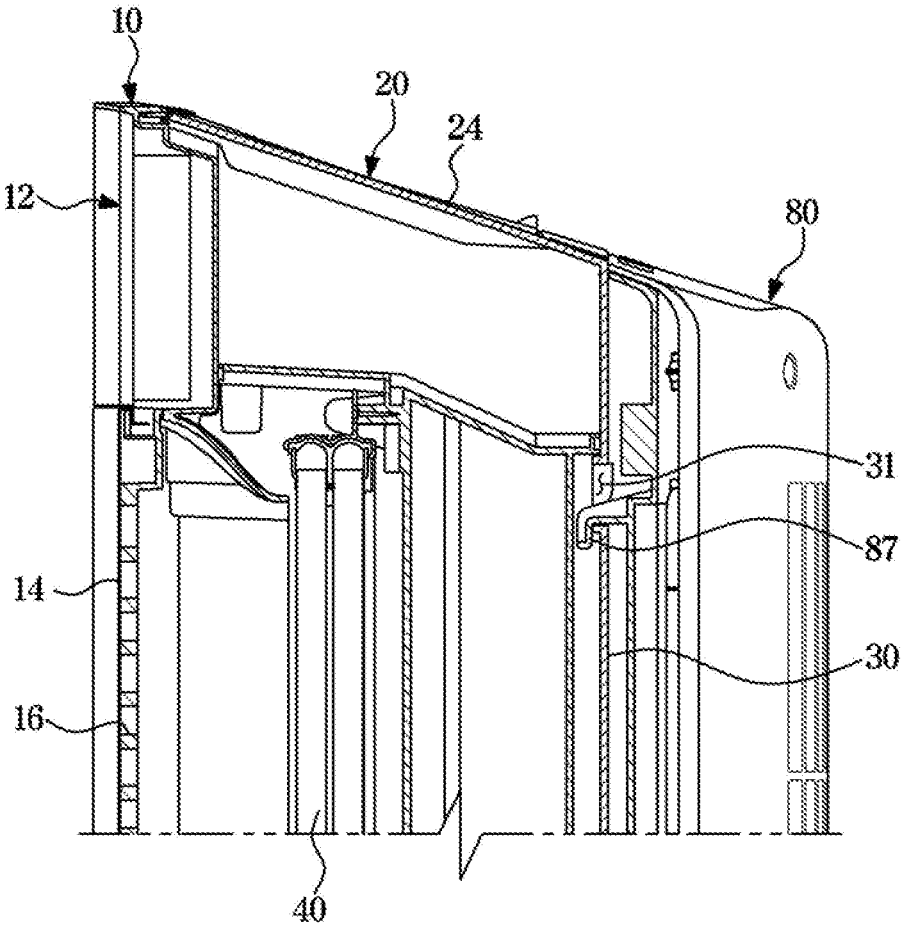
FIG. 9 shows a state in which a hook of a filter assembly is caught by a housing in an air conditioner according to an embodiment of the disclosure.

FIG. 8 is an exploded perspective view of a filter assembly of an air conditioner according to an embodiment of the disclosure, and FIG. 9 shows a state in which a hook of a filter assembly is caught by a housing in an air conditioner according to an embodiment of the disclosure.

The filter assembly 80 may include a filter frame 82, and a filter 81 positioned inside the filter frame 82.

The filter frame 82 may include an inner frame 86 facing the rear panel 30 of the housing 10, and an outer frame 88 being opposite to the inner frame 86 and facing outside. The filter 81 may be positioned between the inner frame 86 and the outer frame 88.

The filter frame 82 may include a filter opening 89 into which the filter 81 is inserted. The filter 81 may be inserted or installed in the filter frame 82 through the filter opening 89. The filter 81 may include an electric dust filter 81, a heap filter 81, an antimicrobial filter 81, and a deodorant filter 81. The kind and number of the filter 81 are not limited.

The filter frame 82 may include a frame body 83 and a frame guard 84.

The frame guard 84 may be formed in a lattice shape to allow air to flow therethrough. The frame guard 84 may protect the fan 52. Also, the frame guard 84 may protect the filter 81 positioned in the filter assembly 80. That is, horizontal guards extending in a horizontal direction may intersect with vertical guards extending in a vertical direction so that air flows through spaces between the horizontal guards and the vertical guards. The frame guard 84 may be formed in at least one frame of the outer frame 88 or the inner frame 86. In the current embodiment, the frame guard 84 may include an inner guard 84*a* formed in the inner frame 86 and an outer guard 84*b* formed in the outer frame 88.

The frame body 83 may be formed along a circumference of the frame guard 84. The frame body 83 may be coupled with the housing 10. The frame body 83 may include an inner body 83*a* formed in the inner frame 86, and an outer body 83*b* formed in the outer frame 88.

The filter assembly 80 may include a hook 87.

The hook 87 may be inserted into and caught by a catching groove 31 formed in the rear panel 30 of the housing 10. When the hook 87 is caught by the catching groove 31, the filter assembly 80 may be temporarily rested on the rear surface of the housing 10. The hook 87 may protrude from a surface of the inner frame 86, the surface facing the rear panel 30 of the housing 10.

The filter assembly 80 may be fixed at the housing 10 by screwing. In a upper portion of the filter frame 82, a second coupling hole 82*a* (see FIGS. 5 and 7) may be formed to overlap with a first coupling hole 25 (see FIGS. 6 and 7) formed in a rear upper portion of the housing 10. By resting the filter assembly 80 on the rear surface of the housing 10 and then putting a screw 82*b* into the first and second coupling holes 25 and 82*a* in the state in which the first and second coupling holes 25 and 82*a* overlap with each other, the filter assembly 80 may be fixed at the housing 10. By inserting the screw 82*b* into the first and second coupling holes 25*a* and 82*a*, the filter assembly 80 may be fixed at the housing 10.

In the current embodiment, a case in which the first and second coupling holes 25 and 82*a* are formed in the upper portions of the housing 10 and the filter assembly 80 has been described. However, the first and second coupling holes 25 and 82*a* may be formed in side portions of the housing 10 and the filter assembly 80. However, when the first and second coupling holes 25 and 82*a* are formed in the rear surfaces of the housing 10 and the filter assembly 80, a wide working space from the rear side of the air conditioner 1 may be required to disassemble the filter assembly 80 from the housing 10. That is, the positions of the first and second coupling holes 25 and 82*a* are not limited as long as the first and second coupling holes 25 and 82*a* are formed in the upper or side surfaces of the housing 10 and the filter assembly 80.

Hereinafter, operations of assembling and disassembling the air conditioner 1 according to the current embodiment will be described.

Figure 10:
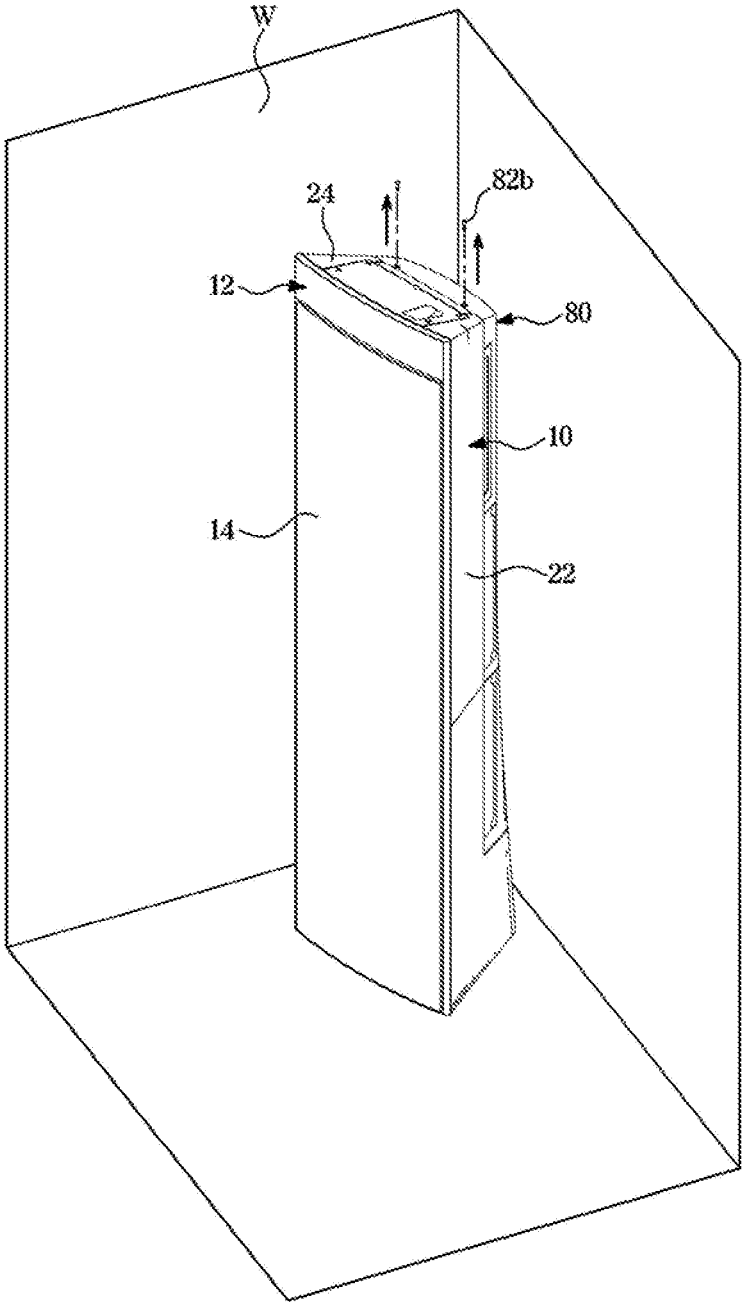
FIGS. 10, 11, and 12 are views related to a disassembly operation of an air conditioner according to an embodiment of the disclosure.
Figure 11:
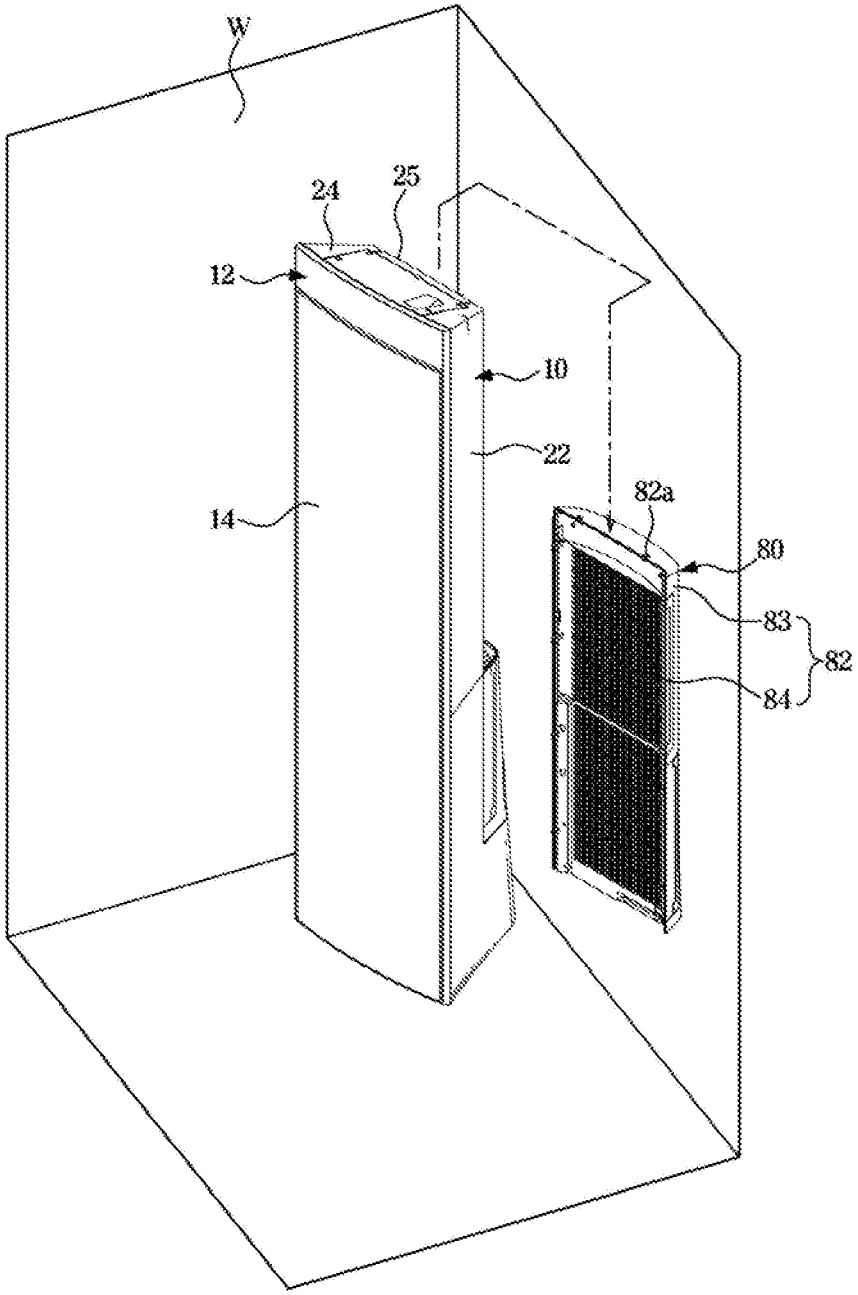
Figure 12:
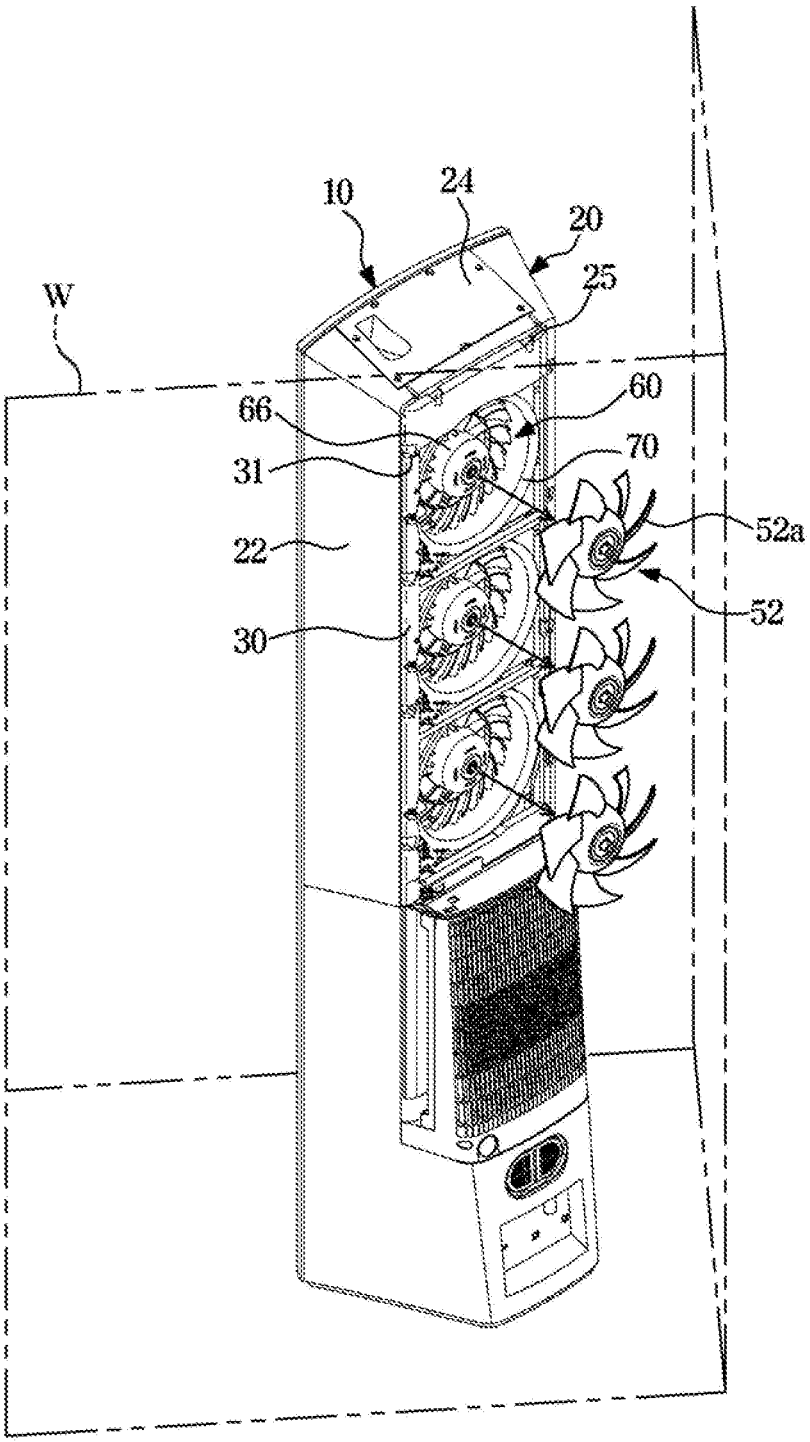

FIGS. 10, 11, and 12 are views related to a disassembly operation of an air conditioner according to an embodiment of the disclosure.

The air conditioner 1 may be positioned at a corner of an indoor space, as shown in FIG. 10. The air conditioner 1 may be positioned at a corner of an indoor space formed by walls W, as shown in FIG. 10. Typically, for maintenance of the fan 52, a work of moving the air conditioner 1 to a wide space has been needed to disassemble the air conditioner 1. However, in the configuration of the disclosure, a work of separating the fan 52 from the air conditioner 1 may be performed without moving the air conditioner 1 for maintenance of the fan 52.

First, a process of disassembling the fan 52 will be described below.

As shown in FIG. 10, the screw 82*b* penetrating the housing 10 positioned at an upper portion of the air conditioner 1 and the first and second coupling holes 25 and 82*a* of the filter assembly 80 may be loosened.

Then, the filter assembly 80 may become a state of being temporarily rested on the catching groove 31 of the housing 10 by the hook 87. Then, by separating the hook 87 from the catching groove 31, the filter assembly 80 may be separated from the housing 10, as shown in FIG. 11.

When the filter assembly 80 is separated from the housing 10, the fan 52 may be exposed to the rear side of the housing 10, as shown in FIG. 12. Then, by decoupling the fan 52 from the fan motor 54, the fan 52 may be separated from the rear side of the housing 10.

A process of assembling the fan 52 with the filter assembly 80 may be performed in reverse order of the process of disassembling the fan 52 from the filter assembly 80.

Hereinafter, an air conditioner according to another embodiment of the disclosure will be described.

In the following descriptions about the current embodiment, descriptions about the same configurations as those described above will be omitted.

Figure 13:
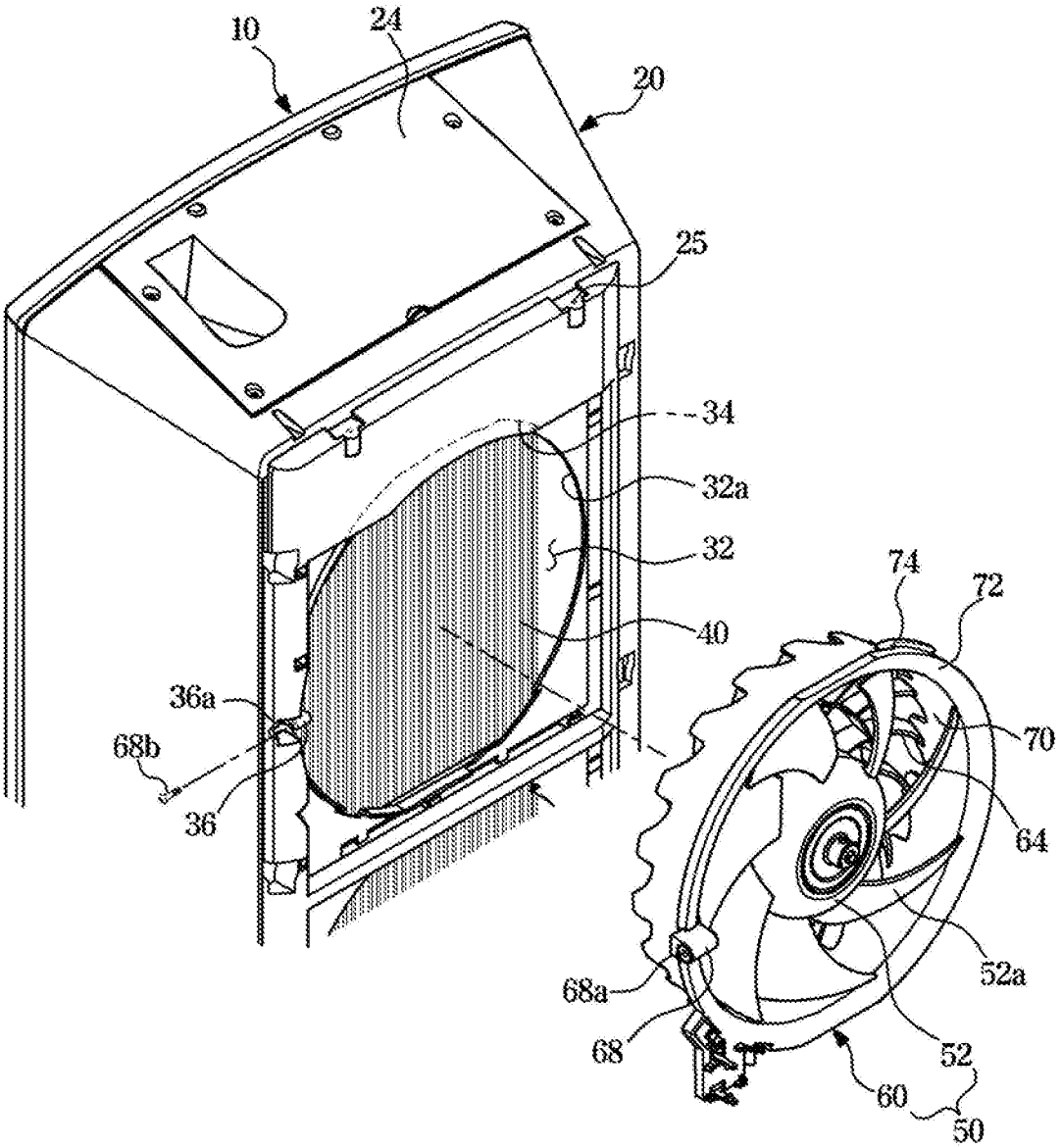
FIG. 13 shows a state in which a fan assembly is separated from a housing in an air conditioner according to an embodiment of the disclosure.
Figure 14:
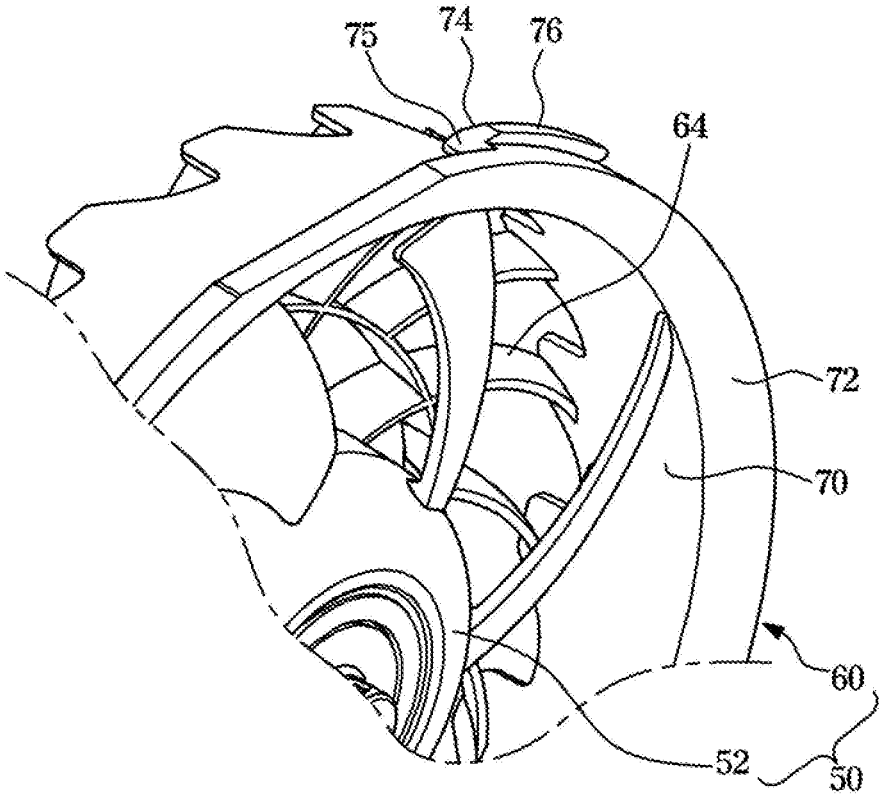
FIG. 14 is an enlarged view of a part of a fan assembly of an air conditioner according to an embodiment of the disclosure.

FIG. 13 shows a state in which a fan assembly is separated from a housing in an air conditioner according to another embodiment of the disclosure, and FIG. 14 is an enlarged view of a fan assembly of an air conditioner according to another embodiment of the disclosure.

In the current embodiment, the fan guard 60 may be configured to be disassembled from the rear panel 30, unlike the above-described embodiment.

The fan guard 60 may include at least one catching protrusion 74.

The at least one catching protrusion 74 may be configured to be caught at the rear panel 30. The catching protrusion 74 may be formed on an outer surface of the fan guard 60. More specifically, the catching protrusion 74 may extend from the shroud 72.

The catching protrusion 74 may include an extension portion 75 extending in the front direction of the rear panel 30 and a catching portion 76 extending in a radial direction of the fan guard 60 from the extension portion 75. The extension portion 75 may pass from a front surface 30*ba* (see FIG. 17) of the rear panel 30 to a rear surface 30*bb* (see FIG. 17) of the rear panel 30.

Figure 15:
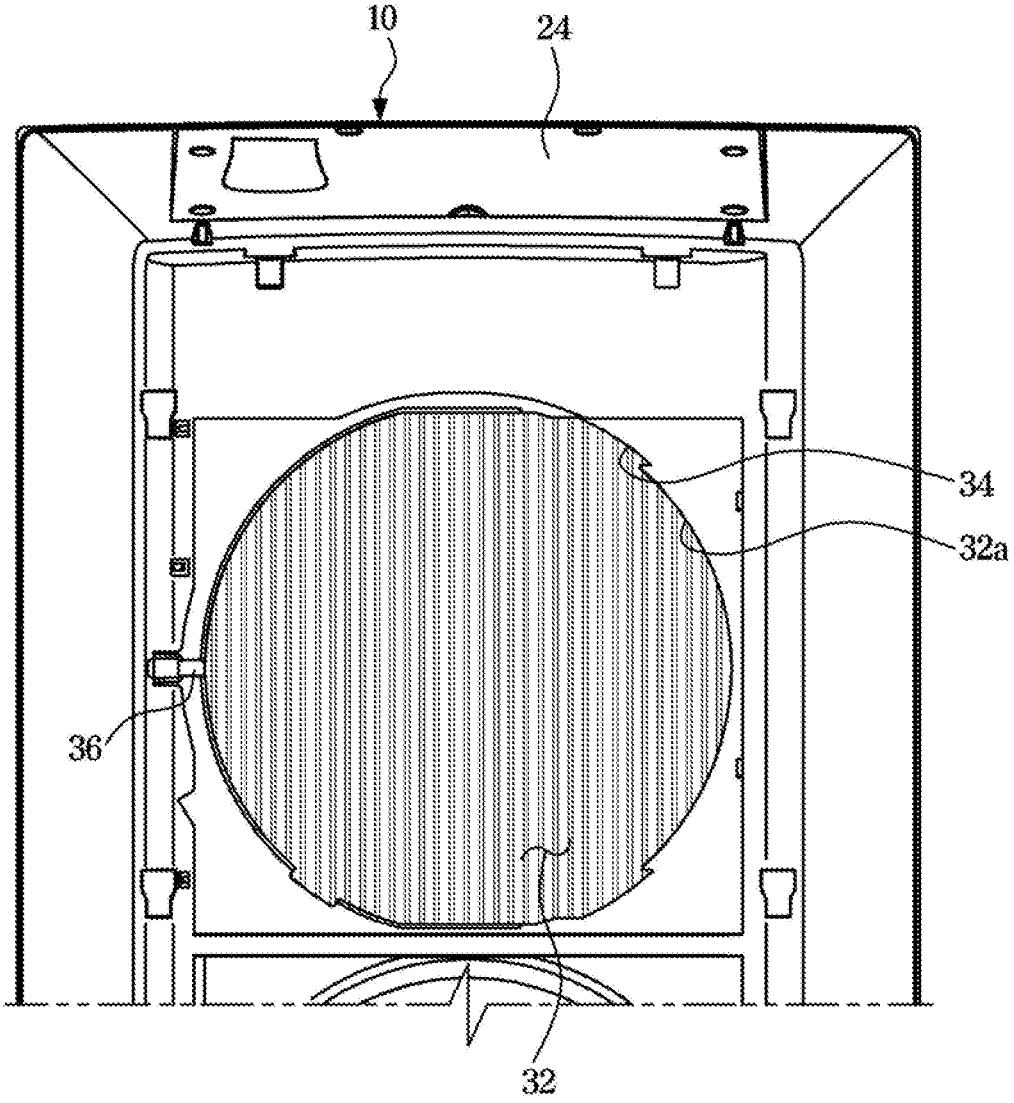
FIG. 15 shows a housing from which a fan assembly has been removed in an air conditioner according to an embodiment of the disclosure, as seen from behind.
Figure 16:
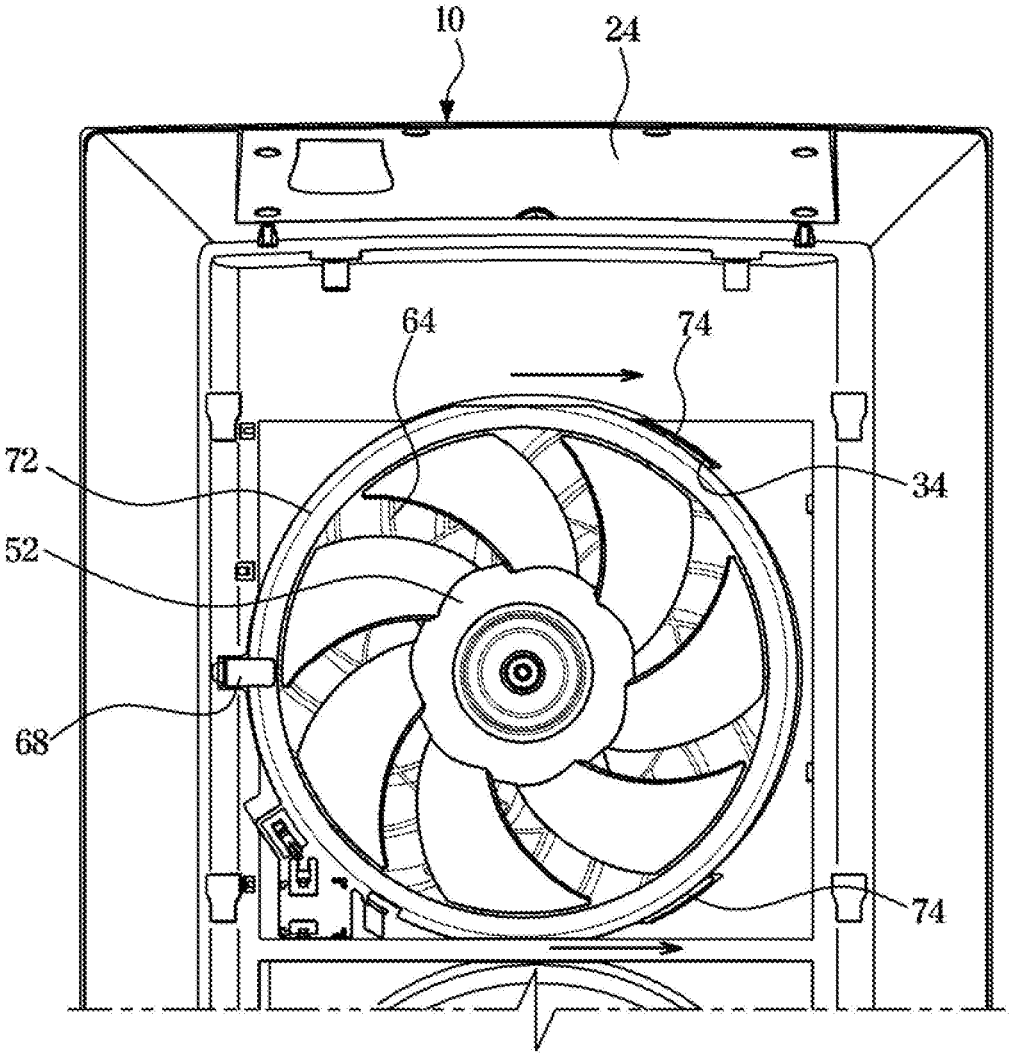
FIG. 16 is a view related to an operation of coupling a fan assembly with a housing in an air conditioner according to an embodiment of the disclosure.
Figure 17:
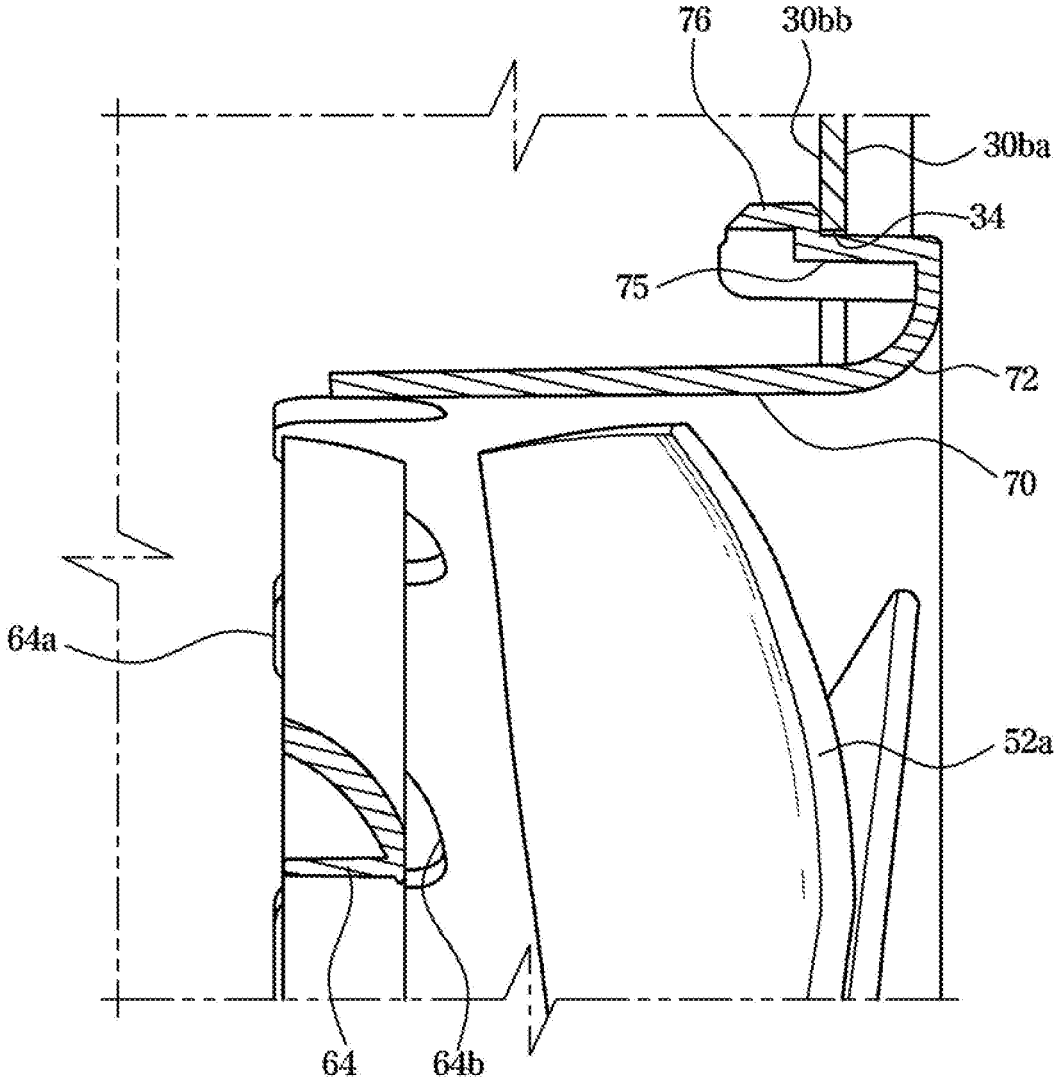
FIG. 17 shows a state in which a catching protrusion is caught at a housing in an air conditioner according to an embodiment of the disclosure.

FIG. 15 shows a housing from which a fan assembly has been removed in an air conditioner according to another embodiment of the disclosure, as seen from behind the housing, FIG. 16 is a view related to an operation of coupling a fan assembly with a housing in an air conditioner according to another embodiment of the disclosure, and FIG. 17 shows a state in which a catching protrusion is caught at a housing in an air conditioner according to another embodiment of the disclosure.

The rear panel 30 may include an insertion opening forming portion 32*a* forming an insertion opening 32 into which the fan guard 60 is inserted, and a protrusion resting portion 34 formed concavely from the insertion opening forming portion 32*a* for insertion of the catching protrusion 74. The protrusion resting portion 34 may extend from the inserting opening forming portion 32*a* in a direction in which the insertion opening 32 expands. After the fan guard 60 is inserted in the insertion opening 32, the fan guard 60 may move left and right so that the catching protrusion 74 is rested on the protrusion resting portion 34. For this, the inserting opening forming portion 32*a* may be formed in the shape of an oval stretched in a left-right direction.

The protrusion resting portion 34 may be positioned at a right side of the insertion opening forming portion 32*a*, as seen from behind the rear side of the rear panel 30. More specifically, the protrusion resting portion 34 may be connected to the insertion opening forming portion 32*a* to be formed around the right side of the insertion opening forming portion 32*a*. By inserting the fan guard 60 in the insertion opening forming portion 32*a* and then moving the fan guard 60 to the right, as shown in FIG. 16, the catching protrusion 74 may be rested on the protrusion resting portion 34.

When the catching protrusion 74 is rested on the protrusion resting portion 34, the extension portion 75 may be in contact with the protrusion resting portion 34, and the catching portion 76 may be in contact with the front surface 30*bb* of the rear panel 30. Because the catching portion 76 is caught at the front surface 30*bb* of the rear panel 30, the fan guard 60 may be prevented from escaping in the rear direction from the rear panel 30.

Figure 18:
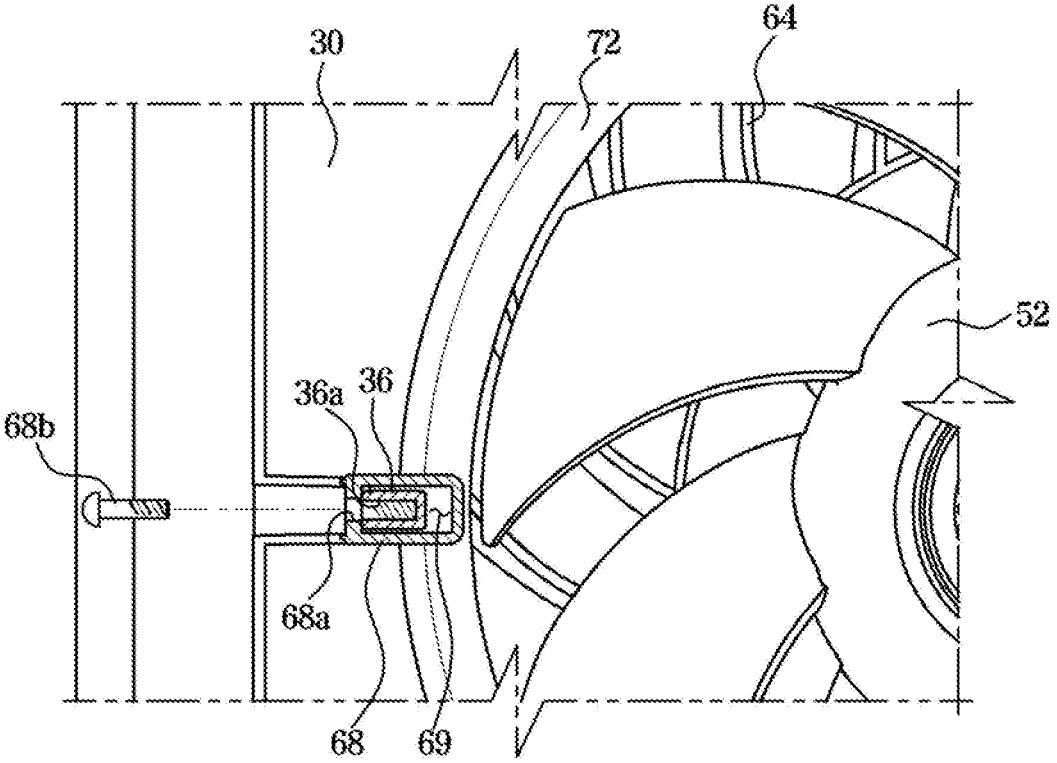
FIG. 18 shows coupling between a panel coupling portion and a guard coupling portion in an air conditioner according to an embodiment of the disclosure.

FIG. 18 shows coupling between a panel coupling portion and a guard coupling portion in an air conditioner according to another embodiment of the disclosure. FIG. 18 shows a cross section of a panel coupling portion 36 and a guard coupling portion 68 when the panel coupling portion 36 overlaps with the guard coupling portion 68. The following description will be given with reference to the drawings described above.

The fan guard 60 may include the guard coupling portion 68.

The guard coupling portion 68 may be screwed with the panel coupling portion 36 of the rear panel 30. The panel coupling portion 36 may protrude from the rear surface of the rear panel 30, and in the panel coupling portion 36, a first fixing hole 36*a* extending in the left-right direction may be formed. The panel coupling portion 36 may be adjacent to the insertion opening forming portion 32*a* into which the fan guard 60 is inserted.

The guard coupling portion 68 may include a second fixing hole 68*a* corresponding to the first fixing hole 36*a* of the panel coupling portion 36 and extending in the left-right direction. The guard coupling portion 68 may cover the panel coupling portion 36 such that the first fixing hole 36*a* overlaps with the second fixing hole 68*a*. The guard coupling portion 68 may be an insertion space formed concavely in the rear direction, and include an insertion space 69 formed in the left-right direction. The panel coupling portion 36 extending in the left-right direction may be inserted in the insertion space 69 of the guard coupling portion 68.

By resting the fan guard 60 on the rear panel 30 and then screwing the first fixing hole 36*a* of the guard coupling portion 68 with the second fixing hole 68*a* of the panel coupling portion 36, the fan guard 60 may be fixed at the rear panel 30.

The first fixing hole 36*a* of the guard coupling portion 68 may be coupled with the second fixing hold 68*a* of the panel coupling portion 36 by a screw 68*b* at a side of the air conditioner 1. Because a screwing work is performed at the side of the air conditioner 1, it may be unnecessary to move the air conditioner 1 for securing a working space for separating the fan guard 60. In the current embodiment, the guard coupling portion 68 may be positioned at a side of the fan guard 60, although not limited thereto. That is, the guard coupling portion 68 may be positioned at an upper portion of the fan guard 60, and the panel coupling portion 36 may be correspondingly positioned at the upper portion of the insertion opening 32.

The at least one catching protrusion 74 and the guard coupling portion 68 may be spaced apart from each other a predetermined distance along a circumference of the fan guard 60. As shown in FIG. 16, in the current embodiment, a pair of catching protrusions 74 may be provided, and a single guard coupling portion 68 may be provided. The pair of catching protrusions 74 and the guard coupling portion 68 may be spaced apart at a distance of about 120 degrees along the circumference of the fan guard 60. As such, by spacing portions holding or coupling the fan guard 60 by a predetermined distance, the fan guard 60 which is substantially in the shape of a cylinder may be stably fixed at the rear panel 30.

In the current embodiment, a configuration for resting the fan guard 60 by inserting the fan guard 60 into the insertion opening 32 of the rear panel 30 and then moving the fan guard 60 to the right has been described. However, the disclosure is not limited to the configuration. For example, by inserting the fan guard 60 into the insertion opening 32 of the rear panel 30 and then rotating the fan guard 60, the catching protrusion 74 may be caught at the front surface of the rear panel 30.

Hereinafter, operations of disassembling and assembling the air conditioner 1 according to the current embodiment will be described.

First, an operation of assembling the fan guard 60 will be described. The following description will be given with reference to FIGS. 13 to 18.

The fan guard 60 may be inserted into the insertion opening 32 of the rear panel 30, and move to the right. When the fan guard 60 moves to the right in the insertion opening 32, the catching protrusion 74 may be rested on the protrusion resting portion 34. The extension portion 75 of the catching protrusion 74 may be in contact with the protrusion resting portion 34, and the catching portion 76 may be in contact with the front surface 30*bb* of the rear panel 30.

Thereafter, the guard coupling portion 68 of the fan guard 60 may be coupled with the panel coupling portion 36 of the rear panel 30 by a screw 68*b* so that the fan guard 60 may be fixed at the rear panel 30.

An operation of disassembling the fan 52 from the filter assembly 80 may be performed in reverse order of the operation of assembling the fan 52 with the filter assembly 80.

Hereinafter, an air conditioner according to another embodiment of the disclosure will be described.

In the following descriptions about the current embodiment, descriptions about the same configurations as those described above will be omitted.

Figure 19:
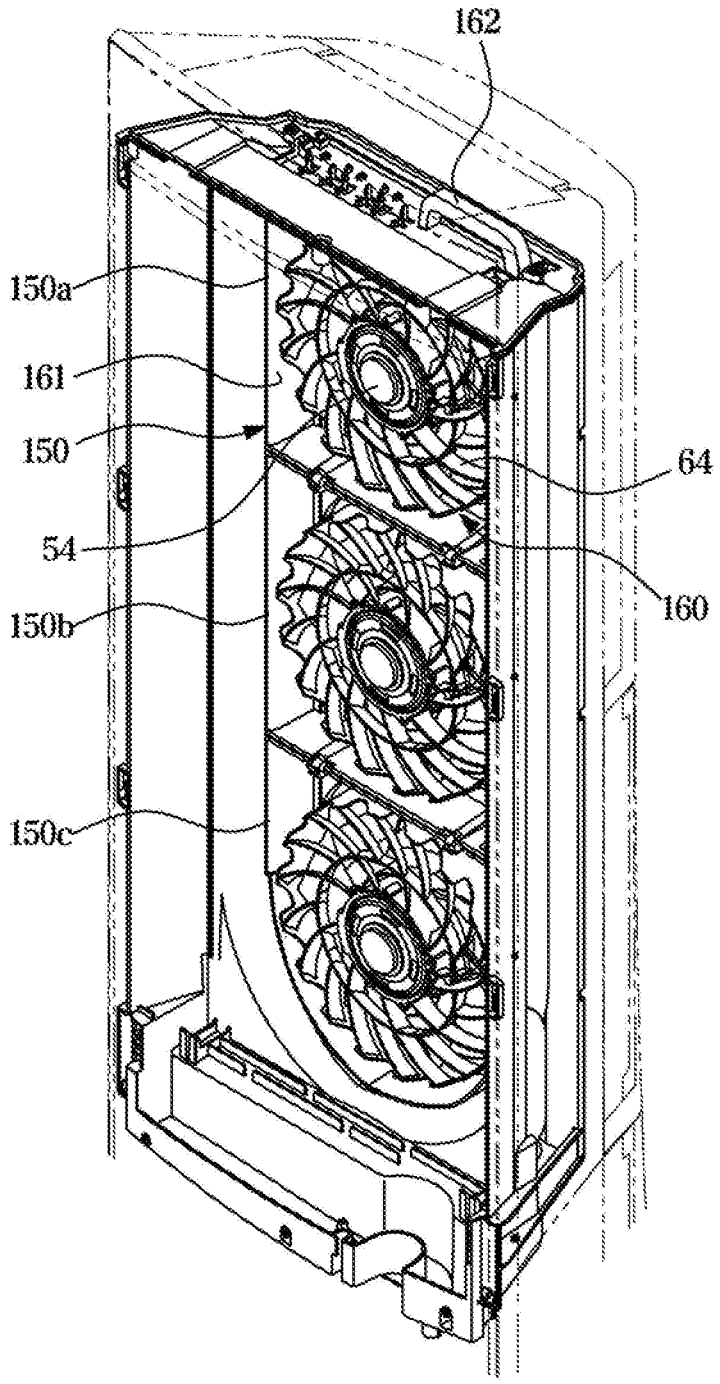
FIG. 19 shows a fan assembly of an air conditioner according to an embodiment of the disclosure.
Figure 20:
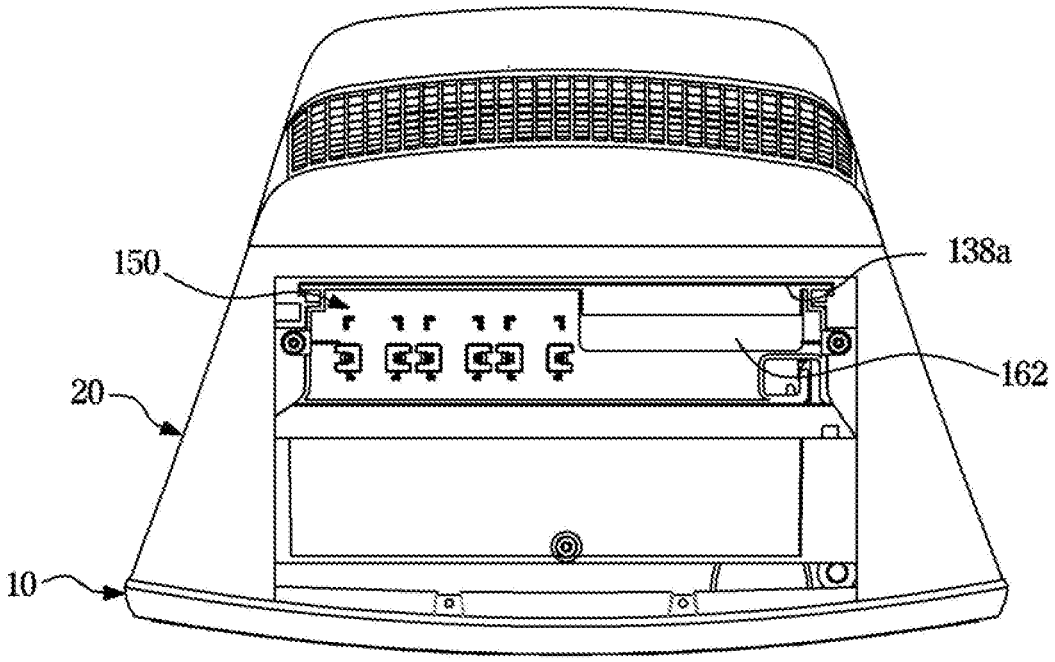
FIG. 20 shows a fan assembly of an air conditioner according to an embodiment of the disclosure, as seen from above.
Figure 21:
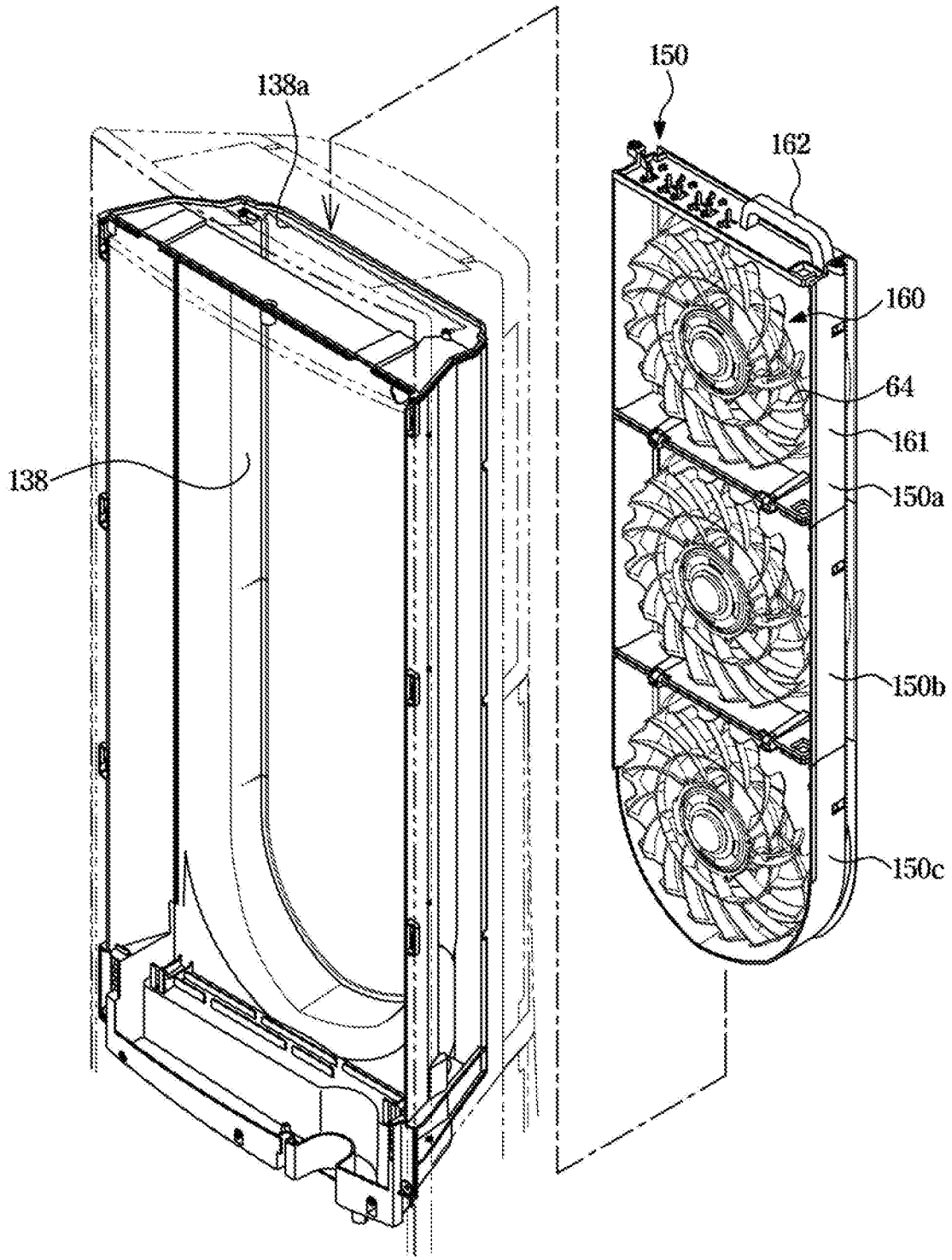
FIG. 21 shows a state in which a fan assembly is separated from a housing in an air conditioner according to an embodiment of the disclosure.

FIG. 19 shows a fan assembly of an air conditioner according to another embodiment of the disclosure, FIG. 20 shows a fan assembly of an air conditioner according to another embodiment of the disclosure, as seen from above, and FIG. 21 shows a state in which a fan assembly is separated from a housing in an air conditioner according to another embodiment of the disclosure.

In the current embodiment, the fan assembly 50 may be separated from above the air conditioner 1. The above-described embodiments relate to a case of separating the filter assembly 80 from the housing 10, however, an operation of separating the filter assembly 80 from the housing 10 is not necessarily performed to separate the fan assembly 50 from the housing 10. The fan assembly 50 may be separated from the housing 10 without separating the filter assembly 80 from the housing 10. However, a configuration for separating the fan assembly 50 from the housing 10 after separating the filter assembly 80 from the housing 10 is also possible.

The air conditioner 1 may include at least one fan assembly 150, and an assembly accommodating portion 138 (an assembly accommodating guide) accommodating the at least one fan assembly 150.

The assembly accommodating portion 138 may be positioned in an inner side of the housing 10. At a top of the housing 10, an opening 138*a* through which the fan assembly 150 is put in and taken out of the housing 10 may be formed. The opening 138*a* may correspond to a cross section in horizontal direction of the fan assembly 150, and allow a user to put the fan assembly 150 in or taken it out of the housing 10 perpendicularly with respect to the opening 138*a*. Although not shown in the drawings, the housing 10 may include an assembly cover (not shown) for opening or closing the opening 138*a*.

The fan assembly 150 may include the fan 52 and a fan guard 160.

The fan 52 may be positioned in the fan guard 160. The fan guard 160 may protect the fan 52 or guide air blown from the fan 52.

The fan guard 160 may include a fan grill 64, a duct 70, and a guard body 161. The guard body 161 may extend from an outer circumference of the duct 70. The guard body 161 may be substantially in the shape of a rectangle.

The fan guard 160 may include a curved guard body 161*a*. The curved guard body 161*a* may be formed at the fan guard 160 of the fan assembly 150 which is at a lowest location among the plurality of fan assemblies 150. The curved guard body 161*a* may be curved at the lower portion. The curved guard body 161*a* may enable the fan assemblies 150 to be stably accommodated and rested in the assembly accommodating portion 138.

The fan guard 160 may include a handle 162 formed in the upper portion of the guard body 161.

When the fan assembly 150 is rested in the assembly accommodating portion 138, the handle 162 may protrude through the opening 138*a* or be positioned adjacent to the opening 138*a*. Therefore, a user may grip the handle 162 to lift the fan assembly 150.

Figure 22:
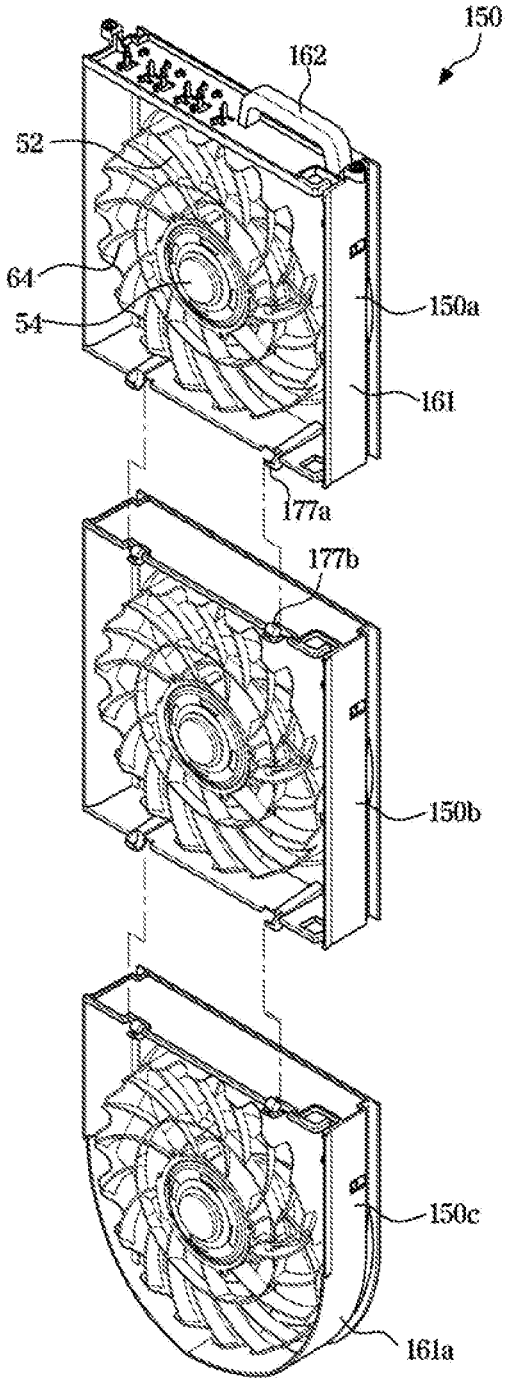
FIG. 22 shows a fan assembly separated from an air conditioner according to an embodiment of the disclosure.
Figure 23:
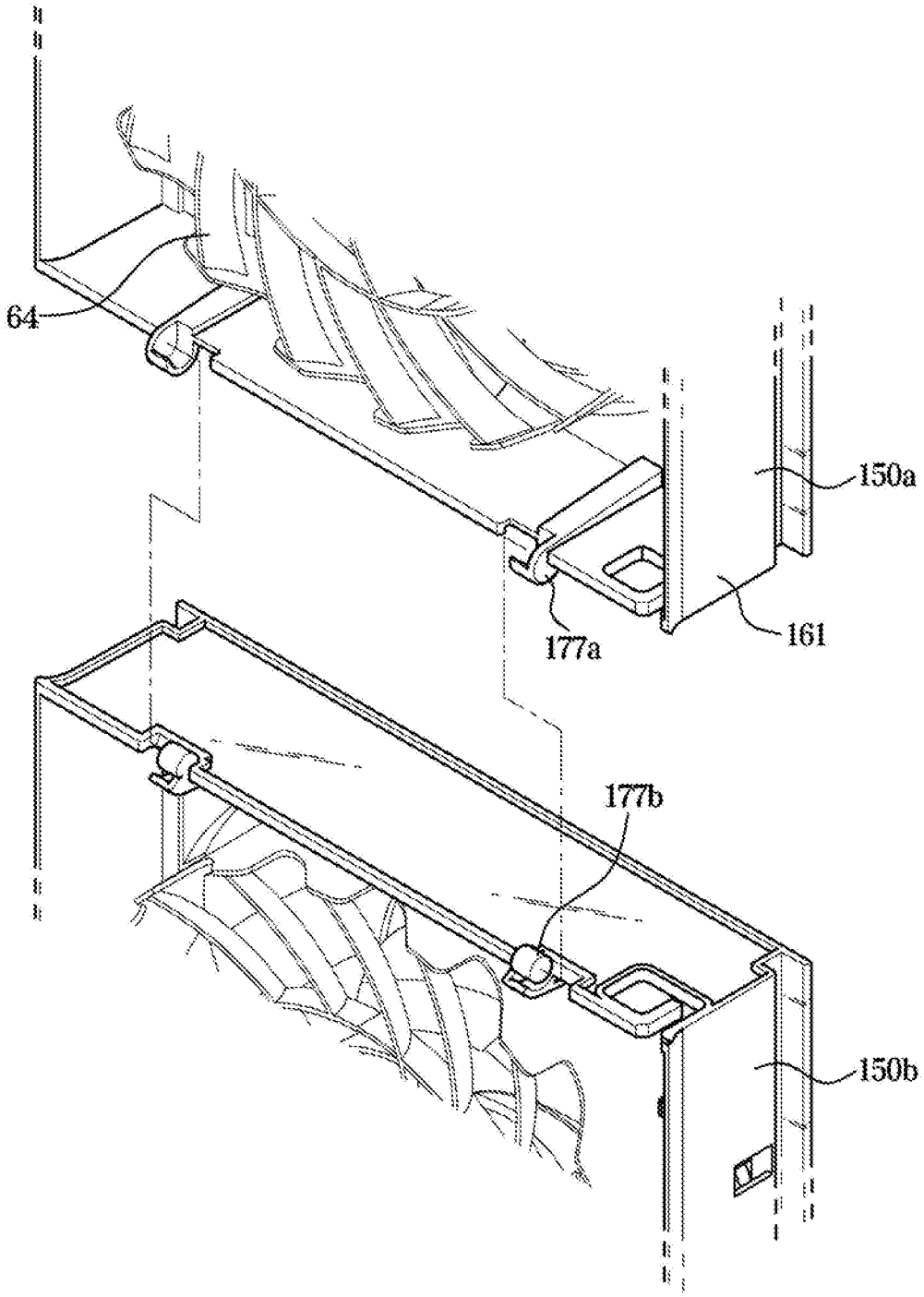
FIG. 23 shows a rotating structure of a fan assembly of an air conditioner according to an embodiment of the disclosure.

FIG. 22 shows a fan assembly separated from an air conditioner according to an embodiment of the disclosure, and FIG. 23 shows a rotating structure of a fan assembly of an air conditioner according to another embodiment of the disclosure.

At least one fan assembly 150 may be provided. In the current embodiment, three fan assemblies 150 (also, referred to as a first fan assembly 150*a*, a second fan assembly 150*b*, and a third fan assembly 150*c*) may be provided. One of the plurality of fan assemblies 150 may be rotatable with respect to another fan assembly 150.

That is, the first fan assembly 150*a* may be rotatable with respect to the second fan assembly 150*b* being adjacent to the first fan assembly 150*a*. When the fan assembly 150 is separated from above the air conditioner 1 in an indoor space, there is a difficulty in separating the fan assembly 150 from the air conditioner 1 due to a limited height of a ceiling. Therefore, by configuring the first fan assembly 150*a* to be rotatable with respect to the second fan assembly 150*b*, the fan assemblies 150 may be separated from the air conditioner 1 without being restricted by the height of the ceiling.

To rotate the first fan assembly 150*a* with respect to the second fan assembly 150*b*, the first fan assembly 150*a* may include a first hinge 177*a*. The second fan assembly 150*b* may include a second hinge 177*b* rotatably connected to the first hinge 177*a*. Because the first hinge 177*a* is rotatably coupled with the second hinge 177*b*, the first and second fan assemblies 150*a* and 150*b* may be rotatable with respect to each other. In the current embodiment, because the three fan assemblies 150*a*, 150*b*, and 150*c* are provided, the second fan assembly 150*b* may be rotatable with respect to the first fan assembly 150*a* positioned above and the third fan assembly 150*c* positioned below. For this, a hinge may also be provided between the second fan assembly 150*b* and the third fan assembly 150*c*.

Hereinafter, operations of disassembling and assembling the air conditioner 1 according to the current embodiment will be described.

Figure 24:
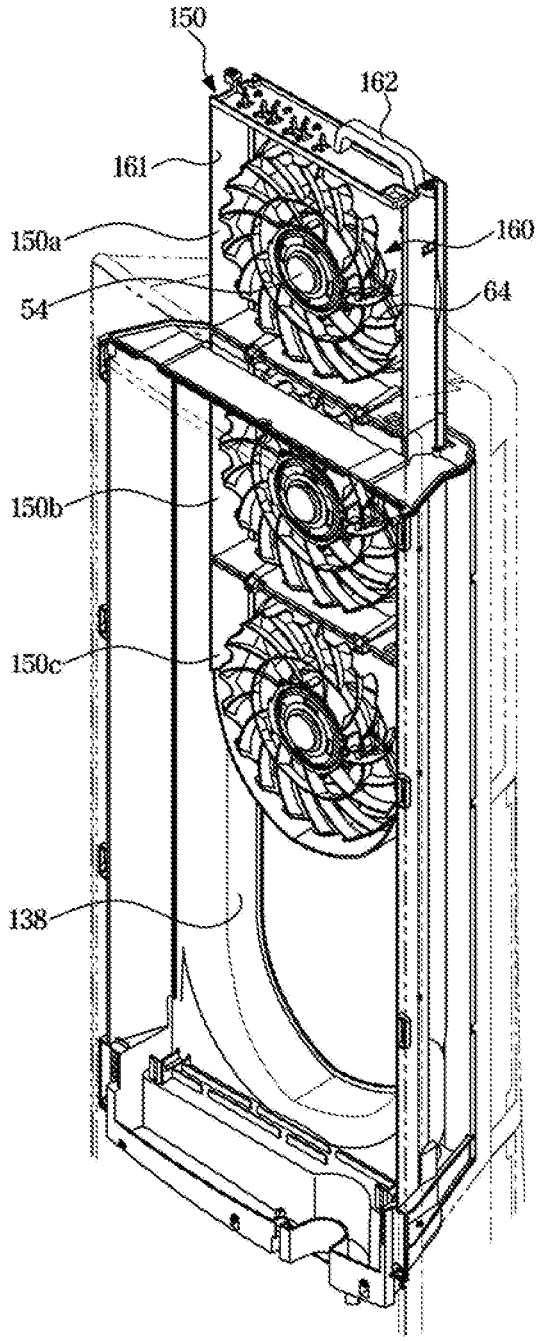
FIGS. 24 and 25 are views related to an operation of a fan assembly that is separated from a housing of an air conditioner according to an embodiment of the disclosure.
Figure 25:
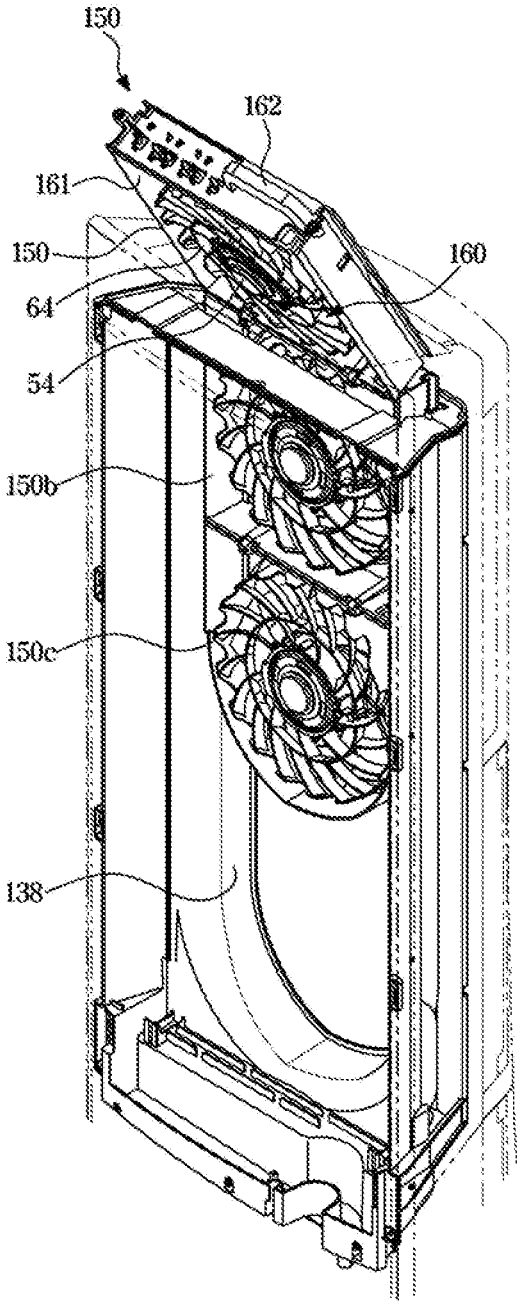

FIGS. 24 and 25 are views related to an operation of a fan assembly that is separated from a housing of an air conditioner according to another embodiment of the disclosure.

First, an operation of disassembling the fan assemblies 150 will be described.

The first fan assembly 150*a* may be lifted upward, and then the second and third fan assemblies 150*b* and 150*c* connected to the first fan assembly 150*a* may also be lifted upward together with the first fan assembly 150*a*. As shown in FIG. 24, when the first fan assembly 150*a* escapes from the assembly accommodating portion 138, the first fan assembly 150*a* may rotate with respect to the second fan assembly 150*b* to be laid, as shown in FIG. 25. Through the operation, the first fan assembly 150*a* may be prevented from being interfered with a ceiling so that the fan assemblies 150 do not escape from the assembly accommodating portion 138.

Thereafter, when the second fan assembly 150*b* is lifted upward, the third fan assembly 150*c* connected to the second fan assembly 150*b* may be lifted upward together with the second fan assembly 150*b*. When the second fan assembly 150*b* escapes from the assembly accommodating portion 138, the second fan assembly 150*b* may rotate with respect to the third fan assembly 150*c* to be laid.

Through the operation, the fan assemblies 150 may escape from the assembly accommodating portion 138 without being interfered with the ceiling to thus be separated from the housing 10.

According to an aspect of the disclosure, by improving the assembly structure of the fan, the assembly efficiency of the air conditioner may be improved.

According to another aspect of the disclosure, by simplifying the assembly and disassembly structure of the fan, a user may easily maintain and repair the air conditioner.

According to another aspect of the disclosure, a user may maintain and repair the fan without a wide working space.

Although a few embodiments of the disclosure have been shown and described, it would be appreciated by those skilled in the art that changes may be made in these embodiments without departing from the principles and spirit of the disclosure, the scope of which is defined in the claims and their equivalents.

What is claimed is:

1. An air conditioner comprising: a housing having a front panel with an outlet formed therein, and a rear panel with an inlet formed therein; a heat exchanger positioned inside the housing; a fan positioned inside the housing to correspond to a position of the inlet along a front-rear direction of the housing; a filter assembly located at an exterior of the housing and provided to be couplable to and decouplable from the rear panel and configured to filter out foreign materials from air entering the housing and cover the inlet when the filter assembly is coupled to the rear panel, wherein the heat exchanger, the fan, and the filter assembly are sequentially arranged along the front-rear direction of the housing, a rear surface of the air conditioner is formed by a rear surface of the rear panel and a rear surface of the filter assembly at an upper portion of the rear surface of the rear panel, the fan is decouplable from the housing through the inlet along the front-rear direction of the housing by decoupling the filter assembly at the upper portion of the rear surface of the rear panel.

2. The air conditioner according to claim 1, further comprising a fan guard having a fan grill guiding air blown from the fan, wherein a front surface of the fan grill faces the heat exchanger, and a rear surface of the fan grill faces the fan.

3. The air conditioner according to claim 2, wherein the filter assembly comprises a frame guard formed in a lattice shape and configured to protect the fan.

4. The air conditioner according to claim 1, further comprising a fan guard couplable to the rear panel, while the fan guard is coupled to the rear panel, the rear panel and the fan guard partition a front space in which the heat exchanger is positioned from a rear space in which the filter assembly is positioned.

5. The air conditioner according to claim 4, wherein the heat exchanger is decouplable from the rear panel along a front direction of the fan guard, and the fan and the filter assembly are decouplable from the rear panel along a rear direction of the fan guard.

6. The air conditioner according to claim 1, wherein the filter assembly comprises:

a filter configured to filter air entering the fan; and a filter frame to support the filter, wherein the filter frame comprises a frame guard formed in a lattice shape to protect the fan.

7. The air conditioner according to claim 6, wherein the filter frame comprises an inner frame and an outer frame, respectively, to support a front side and a rear side of the filter, and the frame guard is formed in the inner frame such that a front surface of the frame guard faces the fan.

8. The air conditioner according to claim 6, wherein the filter assembly comprises a first coupling hole and a second coupling hole, the second coupling hole being formed in an upper portion of the filter frame and overlapping the first coupling hole formed in an upper portion of the housing, and the filter assembly is fixed at the housing when the first coupling hole is screwed in with the second coupling hole.

9. The air conditioner according to claim 1, further comprising a fan guard couplable to the rear panel, and the fan guard is couplable along a rear direction with respect to the rear panel together with the fan.

10. The air conditioner according to claim 9, wherein the fan guard comprises:

at least one catching protrusion couplable to the rear panel; and a coupling portion coupled for the fan guard to be fixed to the rear panel.

11. The air conditioner according to claim 10, wherein the at least one catching protrusion comprises:

an extension portion extending toward a front surface of the rear panel; and a catching portion bent from the extension portion and in contact with the front surface of the rear panel.

12. The air conditioner according to claim 10, wherein the at least one catching protrusion and the coupling portion are spaced apart from each other within a predetermined distance along a circumference of the fan guard.

13. An air conditioner comprising:

a housing having a front panel with an outlet formed therein, and a rear panel with an inlet formed therein;

a heat exchanger positioned inside the housing;

a fan assembly inside the housing and comprising:

a fan guard, and a fan positioned in the fan guard to correspond to a position of the inlet along a front-rear direction of the housing; and a filter assembly located at an exterior of the housing to be couplable to and decouplable from the rear panel of the housing and configured to filter out foreign materials from air entering the housing and cover the inlet when the filter assembly is coupled to the rear panel, wherein the heat exchanger, the fan assembly, and the filter assembly are sequentially arranged along the front-rear direction of the housing, a rear surface of the air conditioner is formed by a rear surface of the rear panel and a rear surface of the filter assembly at an upper portion of the rear surface of the rear panel, the fan is decouplable from the housing through the inlet along the front-rear direction of the housing by decoupling the filter assembly at the upper portion of the rear surface of the rear panel.

14. The air conditioner according to claim 13, wherein the fan guard comprises:

at least one catching protrusion couplable to the rear panel; and a coupling portion coupled for the fan guard to be fixed to the rear panel, wherein the at least one catching protrusion and the coupling portion are spaced apart from each other within a predetermined distance along a circumference of the fan guard.

15. The air conditioner according to claim 13, wherein the filter assembly comprises:

a filter configured to filter air entering the fan; and a filter frame comprising an inner frame and an outer frame respectively supporting a front portion and a rear portion of the filter, wherein the inner frame comprises a frame guard including a front surface facing the fan and which is formed in a lattice shape to protect the fan.

16. The air conditioner according to claim 13, wherein the rear panel and the fan guard are configured to partition a front space in which the heat exchanger is positioned from a rear space in which the filter assembly is positioned.

17. An air conditioner comprising: a housing having a front panel with an outlet formed therein, a rear panel with an inlet formed therein, and an upper panel having an opening formed therein; a heat exchanger positioned inside the housing; a filter assembly located at an exterior of the housing and couplable to and decouplable from the rear panel and configured to filter out foreign materials from entering the housing and cover the inlet when the filter assembly is coupled to the rear panel; a fan assembly to be positioned inside the housing between the heat exchanger and the rear panel and configured to be coupleable to and decouplable from the rear panel, the fan assembly comprising: a fan guard, and a fan positioned in the fan guard and configured to blow air to the heat exchanger; and an assembly accommodating guide positioned inside the housing and configured to guide the fan assembly along a longitudinal direction of the housing so that the fan assembly is couplable to and decouplable from the housing through the opening formed in the upper panel, wherein the heat exchanger, the fan assembly, and the filter assembly are sequentially arranged along a front-rear direction of the housing, a rear surface of the air conditioner is formed by a rear surface of the rear panel and a rear surface of the filter assembly at an upper portion of the rear surface of the rear panel, the fan is decouplable from the housing through the inlet along the front-rear direction of the housing by decoupling the filter assembly at the upper portion of the rear surface of the rear panel.

* * * * *